US005636839A

United States Patent [19]

Oda

[11] Patent Number: 5,636,839

[45] Date of Patent: Jun. 10, 1997

[54] GROUP FORTUNE TELLING ATTRACTION SYSTEM

[75] Inventor: Takashi Oda, Ohta-Ku, Japan

[73] Assignee: Sega Enterprises, Ltd., Tokyo, Japan

[21] Appl. No.: 395,879

[22] Filed: Feb. 28, 1995

[30] Foreign Application Priority Data

| | | | |
|---|---|---|---|
| Feb. 28, 1994 | [JP] | Japan | 6-052649 |
| Feb. 28, 1994 | [JP] | Japan | 6-052650 |
| Feb. 28, 1994 | [JP] | Japan | 6-052651 |
| Apr. 11, 1994 | [JP] | Japan | 6-096918 |

[51] Int. Cl.[6] ..... A63F 9/06; A63F 9/24

[52] U.S. Cl. ..... 273/161; 472/57

[58] Field of Search ..... 273/161, 459; 472/57, 75, 92; 52/6–10; 181/30; D25/12

[56] References Cited

FOREIGN PATENT DOCUMENTS 6-15062 4/1992 Japan .

*Primary Examiner*—William M. Pierce

[57] ABSTRACT

An interactive control unit for determining inquiries to each of participants by images on the basis of inputted personal information of each of the participants, determining a next inquiry to each of the participants on the basis of a response of each of the participants inputted from an input unit and repeating inquiry/response relating to the attraction by an interactive method is provided for a host computer. A sensor for detecting whether or not a portable device placed in a receiving portion is touched is provided for the input unit so that input of a response from each participant is performed by touching/releasing the hand from the portable device. Further, portable devices each including ID each of which is carried by the participant of the attraction and terminal units each having an ID reading function for reading the ID of the portable devices each including ID placed in receiving portions are provided, wherein control systems of the attraction system discriminate the participants on the basis of the ID read by the terminal units and discriminate the positions of the participants on the basis of the ID and identifier of the terminal unit. Still further, personal information of each participant inputted from an input terminal unit is totaled, and a specific person is selected from the participants that meets predetermined conditions of the theme of the attraction on the basis of the totaled information. An illumination command is transmitted to the terminal unit of the selected specific person to irradiate the portable device with light by a light emitting unit of the terminal unit so as to cause the inner surface of the portable device emit light.

24 Claims, 18 Drawing Sheets

| No. | ITEM | TYPE | |
|---|---|---|---|
| 1 | PROFILE | | : FIXED |
| 2 | LOVE | FORTUNE OF LOVE | : FIXED |
| 3 | | ADVISE FOR FUTURE | : FIXED |
| 4 | | FORTUNE IN THIS WEEK | : CHANGEABLE |
| 5 | MONEY | FORTUNE IN MONEY | : FIXED |
| 6 | | ADVISE FOR FUTURE | : FIXED |
| 7 | | FORTUNE IN THIS MONTH | : CHANGEABLE |
| 8 | HEALTH | FORTUNE OF HEALTH | : FIXED |
| 9 | | ADVISE FOR FUTURE | : FIXED |
| 10 | | FORTUNE IN THIS MONTH | : CHANGEABLE |
| 11 | STUDY | TALENT AND APTITUDE | : FIXED |
| 12 | | ADVISE FOR FUTURE | : FIXED |
| 13 | | FORTUNE IN THIS MONTH | : CHANGEABLE |
| 14 | BUSINESS | TALENT AND APTITUDE | : FIXED |
| 15 | | ADVISE FOR FUTURE | : FIXED |
| 16 | | FORTUNE IN THIS MONTH | : CHANGEABLE |
| 17 | SEX (18 YEARS OR OLDER) | FORTUNE IN SEX | : FIXED |
| 18 | | ADVISE FOR FUTURE | : FIXED |
| 19 | | FORTUNE IN THIS WEEK | : CHANGEABLE |

FIG. 8A

| No. | ITEM | TYPE | |
|---|---|---|---|
| 20 | COMPATI-BILITY IN LOVE | FORTUNE OF LOVE | : FIXED |
| 21 | | COMPATIBILITY | : FIXED |
| 22 | | FORTUNE IN THIS WEEK | : CHANGEABLE |
| 23 | COMPATI-BILITY IN MARRIAGE | FORTUNE IN MARRIAGE | : FIXED |
| 24 | | COMPATIBILITY | : FIXED |
| 25 | | FORTUNE IN THIS WEEK | : CHANGEABLE |
| 26 | COMPATI-BILITY IN SEX | FORTUNE IN SEX | : FIXED |
| 27 | | COMPATIBILITY | : FIXED |
| 28 | | FORTUNE IN THIS WEEK | : CHANGEABLE |
| 29 | COMPATI-BILITY IN FRIENDSHIP | FORTUNE IN FRIENDSHIP | : FIXED |
| 30 | | COMPATIBILITY | : FIXED |
| 31 | | FORTUNE IN THIS WEEK | : CHANGEABLE |

FIG. 8B

| No. | ITEM | TYPE |
|---|---|---|
| 32 | INTERACTIVE FORTUNE TELLING | SUN AND SIGN |
| 33 | | MOON AND SIGN |
| 34 | PSYCHOLOGICAL TEST | VIEW OF LIFE |
| 35 | | VIEW OF LOVE |
| 36 | | INTEREST IN SEX |

I, THE SUN BRIGHTENING THE FUTURE, FOUND PERSONS HAVING THE STAR BRINGING LUCK IN SEEING YOU. NOW, I'LL, TELL YOU THE FUTURE OF THE PERSON. THE PERSONS EACH HAVING THE CUDE WHICH IS INTENSELY LIT BY ME HAVE GOOD FUTURE IN EVERYTHING YOU WANT. AMONG THE LUCKY PERSONS, THE PERSON SUPPLIED WITH MY STRONG FORCE IS IN GOOD HARMONY BETWEEN THE BODY AND THE SPIRIT AND ABLE TO MAKE A GREAT LEAP DUE TO GREAT FORTUNE. THE PERSON IS, YOU!

A

B

FIG.15

1. I AM OF AN EASY RECONCILE TYPE, AND NEVER FLUSTERED IN ANY EMERGENCY.

2. I USUALLY DOUBT COMMON SENSE.

3. I LIKE WORK.

4. I ENJOY MYSELF SURPRISING OTHERS.

5. ALTHOUGH MY FAVORITE THING IS DANGEROUS, I CANNOT STOP DOING THIS.

6. I AM AFRAID I AM MANIAC.

7. FLOWERS, WHICH WILL BE DEAD, ARE MISERABLE

8. I WANT TO PRESENT A LARGEST POSSIBLE BOUQUET

9. I MAKE A RULE TO BE LATE FOR A DATE.

10. I AM SELF-POSSESSED IN WALKING HAND IN HAND OR TOUCHING THE BODY OF THE LOVER.

11. I HARDLY GLANCE AT A PERSON OF THE OTHER SEX.

12. IF A PERSON IS SELF-CONSCIOUS, I INADVERTENTLY MAKE FUN OF THE PERSON.

13. I CANNOT STOP TALKING IF STARTED.

FIG.18

GROUP FORTUNE TELLING ATTRACTION SYSTEM

BACKGROUND OF THE INVENTION

1. Field of the Invention

The present invention relates to a multiperson participating type attraction system with which many participants are able to simultaneously experience an attraction, and more particularly to an attraction system with which inquiries made from the system to all participants by means of an image and answering from each participant are repeated to enable an attraction, such as fortune telling, to be performed. More particularly, the present invention relates to an attraction system using portable terminals such that portable terminals each including an ID system are used to automatically discriminate participants so as to perform an attraction for the participants.

2. Description of the Related Art

An attraction system in which a multiplicity of persons participate to enjoy an attraction in a live site while seeing a displayed image has an arrangement that a three-dimensional image is displayed or sound effects are enhanced so as to heighten the stage effects. With the foregoing attraction system, the participants are permitted to only enjoy seeing the image and the image displayed on a screen or the like has the same contents at each attraction if the theme is the same.

As a system with which the audience is able to input answers with respect to questions in the form of pictures from the system as well as a multiplicity of the participants enjoy seeing a picture and hearing sound, an educational system in a driving school or a system for use in a TV quiz show are exemplified. The audience participation type system has an arrangement that the participants respectively input answers by, for example, depressing a button of an input device with respect to questions made by means of pictures, and the totaled input results or the like are displayed.

A multiplicity of unmanned computer fortune telling apparatus for operational use using a computer have been available. The computer fortune telling apparatus is used in such a manner that a person requiring fortune telling (hereinafter referred to as a "player") inputs personal information, such as date of the birth, so that the apparatus is able to tell fortunes and compatibility of the player. The computer fortune telling apparatus is usually arranged such that one or two players enter a box and fortune telling is performed in the box.

On the other hand, another fortune telling system has been realized which comprises a plurality of data input stages and a plurality of fortune telling result display stages, wherein each player moves to each stage so that fortune telling is performed. In the foregoing fortune telling system, different personal information is sequentially stored in a data storing means at each data input stage, the fortune telling is performed in accordance with the stored personal information, and the result is displayed on a display medium at a fortune telling result display stage. The data storing means is able to store a variety of personal information items. Each player has a data storage means when the player moves to the respective stages (refer to Japanese Patent Laid-Open No. 6-15062).

However, the foregoing audience participation type system causes the participants to only answer questions from the system and is a simple interactive system with which only the system proceeds with the process. Although the multiperson participating attraction system includes a similarly simple interactive system, no attraction system has been realized in which one-to-one bidirectional information transmission is performed to proceed with the attraction for the participants while reflecting information from the participants. Furthermore, no attraction system has been realized in which a specific person is selected from participants to proceeds with the attraction. That is, no interactive conversational system has been available in which participants and the system mutually affect and in which the contents to be executed and displayed are changed. Therefore, the participants are always in a passive state, and thus the participants cannot feel participation in the attraction and the displayed image is the same at each attraction if the theme is the same. With an attraction system, each of the participants takes an arbitrary seat. However, no attraction system has been realized in which the types of persons and the corresponding seats are automatically discriminated and the attraction is performed in accordance with the results of the discrimination.

The foregoing conventional operational unmanned computer fortune telling apparatus or system causes each player to answer the question from the system and thus the player is always brought to a passive state. Therefore, there arises a problem in that the number of the types of the fortune telling has been limited and monotonous fortune telling operations have been permitted. Another problem rises in that since one or two players perform the fortune telling operations, a plurality of persons in a group cannot simultaneously play the fortune telling operation.

SUMMARY OF THE INVENTION

In view of the foregoing, an object of the present invention is to provide an attraction system with which a multiplicity of players are able to simultaneously play an attraction such as a fortune telling operation and which is able to perform interactive attraction such that each player and the system are mutually affected and thus the contents of execution and the displayed contents are changed. Another object of the present invention is to provide an attraction system which is capable of automatically discriminating places and actions of the participants when each participant performs an operation, and is further capable of performing an attraction for the participants while reflecting information from the participants. Still another object of the present invention is to provide a fortune telling system capable of producing a variety of stage effects.

Further, another object of the present invention is to provide an attraction system having a function of selecting a specific person, in which a specific person is selected from participants to proceed with an attraction, thus enabling the participants to feel participation in the attraction. A further object of the present invention is to provide an interactive type attraction system in which interactive control with each player (participant) can be performed and each participant is able to feel participation in the attraction. Furthermore, an object of the present invention is to provide an interactive type attraction system in which each answer of a question made to the player through a picture can be discriminated by a sensor and the results of execution of the attraction can be formed and printed out for each player.

According to one aspect of the present invention, for achieving the objects described above, there is provided a fortune telling/attraction method in which fortune telling or attraction of respective participants are executed in accordance with fortune telling/attraction information, comprising the steps of: preparing an input stage for inputting information and an output stage for processing the inputted information and then outputting the processed information; making said respective participants move from said input stage to said output stage; inputting the fortune telling/attraction information at said input stage or on the way of said movement; storing the fortune telling/attraction information in a data storing means; processing the data stored in said data storing means; and outputting the processed fortune telling results or the processed attraction results to an output means in said output stage.

According to another aspect of the present invention, there is provided an attraction system of a multiperson participating type that permits a multiplicity of participants to experience an attraction, which comprises: a moving path wherein the participants move; an input stage for personal information input and an execution stage for the attraction, which are provided along said moving path; an ID including means each of which includes ID for identifying the participants and carried by each participant; a first input means disposed at said input stage and transmits inputted personal information of said perticipants with ID read from said ID including means; a second input means disposed at said execution stage and transmits input information inputted by said participants with ID read from said ID including means; and a control means which in paralled executes attraction for the participant only to the multiperson on the basis of said personal information and said input information stored corresponding to the ID.

Further, according to still another aspect of the present invention, there is provided an attraction system using portable devices each including ID of a multiperson participating type that permits a multiplicity of participants to experience an attraction, said attraction system using portable devices each including ID comprising: portable devices each including ID each of which is carried by the participant of said attraction; and terminal units each having an ID reading function for reading the ID of said portable devices each including ID placed in receiving portions, wherein the participants are discriminated on the basis of the ID read by said terminal units and positions of the participants are discriminated on the basis of the ID and identifier of said terminal unit.

Still further, according to another aspect of the present invention, there is provided an attraction system having a function of selecting a specific person of a multiperson participating type that permits a multiplicity of participants to experience an attraction, said attraction system having a function of selecting a specific person comprising: selecting means that totals inputted personal information of the participants to select a specific person from the participants that meets predetermined conditions for a theme of the attraction on the basis of the totaled information.

Furthermore, according to still another aspect of the present invention, there is provided an interactive type attraction system of a multiperson participating type that permits a multiplicity of participants to experience an attraction, said interactive-type attraction system comprising: interactive control means which determines inquiries to each of the participants by means of images on the basis of inputted personal information of each of the participants, which determines a next inquiry to each of the participants on the basis of a response of each of the participants inputted from an input unit and which repeats inquiry/response relating to the attraction by an interactive method. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 8A and 8B are a list showing a specific example of items and types of the fortune telling;

FIG. 15 shows an example of a comment of a result of the fortune telling to be displayed on a screen in the live site;

FIG. 18 shows an example of answers to be displayed on the screen in the live site;

DESCRIPTION OF THE PREFERRED EMBODIMENTS

Figure 1:
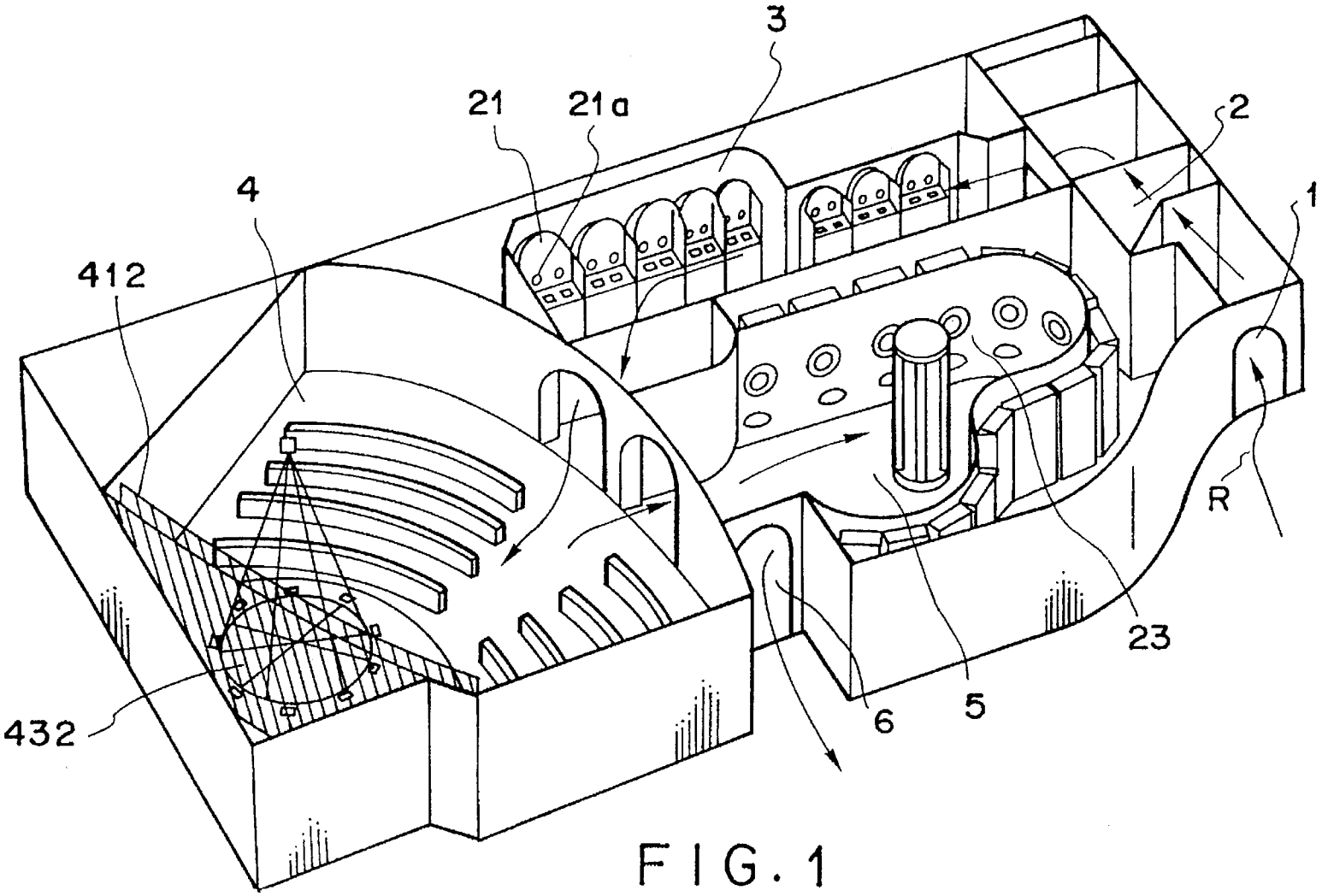
FIG. 1 is a perspective view showing an example of an overall shape of a fortune telling system according to the present invention.

According to the present invention, fortune telling for a subject person is performed by a fortune telling control means on the basis of personal information inputted by a first input means in an input room. During execution of the fortune telling process, a fortune telling common to all participants is performed in a live site. In the live site, image output is performed by an image output means on a curved screen, and sound output is performed by a sound/voice output means so that inquiries are made by means of images and voices. By touching an ID including means by the hand of the player, answer of the inquiry is inputted. On the basis of the data of answers, the fortune telling is performed. During execution of the fortune telling, the image output means projects images on the curved screen and the sound/voice output means outputs effect sounds and voices so that the contents of the fortune telling are commented by means of images and voices.

In the live site, a laser beam projecting means projects laser beams to a circular screen so that images relating to the fortune telling are formed. Therefore, each player is able to enjoy various stage effects while watching images projected on the curved screen and laser-beam images formed on the circular screen and hearing audio comments and effect sounds.

On the basis of the ID read from the ID including means, the players and the corresponding seats can be discriminated. Therefore, the foregoing interactive type fortune telling and as well as peculiar fortune telling on the basis of personal information of each participant can be performed in the live site. For example, a player meeting predetermined conditions is selected from the players as a result of the fortune telling performed on the basis of the totaled personal information. The seat of the selected player is discriminated so that selection can be informed to the selected player. The fact of the selection can be informed by a second input means which lights up the ID including means. The results of the fortune telling performed on the personal information from the first input means and the results of the fortune telling performed on the basis of data of answers of the participants from the second input means are printed out by a fortune telling result output means and as well as notified to the player by means of images and sounds by the image output means and the sound/voice output means.

According to the present invention, since the participants are discriminated on the basis of the ID of the portable device including ID read by the terminal unit, a simple operation for each player (participant) to place the portable device including ID in a predetermined place enables the players to be discriminated automatically. Since the position of the player is discriminated on the basis of the ID and the identifier of the terminal unit, the player and the position of the player who has inputted information through the terminal unit can be discriminated automatically. The input information from the terminal unit for each player is stored to reflect information from the player. Thus, one-to-one bidirectional information transmission is performed so that the attraction for the players can be allowed to proceed in such a manner that the information from the players is reflected.

According to the present invention, a specific person meeting predetermined determined conditions for the theme of the attraction can be selected from the participants on the basis of inputted personal information of each player (participant). Therefore, the input information of each player can be reflected on the contents of the attraction to be executed. Therefore, each player is provided with a feeling of participating in the attraction. Since the specific person is selected from a multiplicity of players and the fact of the selection is notified to the selected person in the place where the selection has been performed. Therefore, the player is tensed and able to further enjoy the attraction. Since the contents of the attraction vary at each participation, the repeatedly enjoyment is permitted.

According to the present invention, an interactive control means causes the input information from each player to reflect on the contents of the attraction to be executed. Therefore, each player is provided with a feeling of participating in the attraction. Since the contents of the attraction are varied at each participation, repeated enjoyment is permitted. Since the input of the answer is performed by the player touching the portable device by the hand, a psychological effect can be produced if the system is applied to a fortune telling system or the like. As compared with the interactive attraction system of a multiperson participating type in which the players watch the images in the attraction site and thus the playing of the attraction is completed in the site, the present invention has an arrangement that the players answer while watching images and the results in the form of printed paper can be received. Therefore, variety of enjoyment can be produced.

FIG. 1 is a perspective view showing an example of the shape of a fortune telling system according to the present invention. Initially, the schematic structure of the system will now be described with reference to FIG. 1. Although fortune telling will be described as an example of the following embodiment, the system according to the present invention is not limited to the fortune telling system. The system can be applied to a system other than the attraction system, for example, an educational system. The illustrated fortune telling system is disposed in a section of an amusement park called a theme park. A room, in which the fortune telling is performed, has a large size and is divided into an input room 3 in which personal information of a player is inputted, a live site 4 which is the main site for the fortune telling, and a printing room 5 in which paper showing the results of the fortune telling is received, each area being able to accommodate up to about 50 people. The participants (players) for the fortune telling attraction form groups each including about 50 people that move to each area along a regular route represented by an arrow R while each having a portable terminal including ID (hereinafter referred to as an "ID pyramid") formed into a pyramid-like shape.

Then, the schematic process will now be described along the regular route. Each player initially passes through an entrance 1 and makes a procedure at a reception area 2 disposed adjacent to the entrance 1. The participant receives the ID pyramid and enters the input room 3 while having the ID pyramid. In the input room 3 a plurality of input terminal devices 21 are disposed. Each player places the ID pyramid on a receiving portion 21*a* of the input terminal device 21 to input personal information, such as name, sex, date, time and place of birth, and fortune telling items (items of fortune telling) in accordance with a guide screen displayed on a panel portion of the input terminal device 21. The inputted personal information is, together with ID information read from the ID pyramid, transmitted to a host computer to be stored in an information storage area which corresponds to each ID (an identifier for identifying the participants). The player who has completed the inputting operation moves to the live site (execution stage) 4, which is the main site for the fortune telling operation while having the ID pyramid.

The live site 4 is formed into a theater-like shape having a plurality of seats arranged annularly. A concave screen (hereinafter referred to as a "curved screen") 412 is disposed in front of the seats so that an image can be projected by three projectors. At a position more adjacent to the participants than the curved screen 412, a circular laser beam projecting screen 432 is disposed so that stage effects are enhanced by projecting laser beams or the like. Each player who has entered the live site 4 takes an arbitrary seat and places the ID pyramid on a receiving portion of a terminal unit (hereinafter referred to as a "pyramid terminal unit") (not shown).

In accordance with the ID of the ID pyramid received by the pyramid terminal unit, the host computer discriminates the players and their seats. By displaying an image on the curved screen 412, the host computer makes inquiries and performs fortune telling common to all participants. For example, each player touches the ID pyramid to input an answer so that inquiries from the system and answer of the player are repeated to perform an interactive fortune telling. Results of the fortune telling performed in the live site 4 are notified by means of images and sound. A portion of the fortune telling performed in the live site 4 is informed to each participants by paper indicating the results in an adjacent printing room (output stage) 5. After fortune telling to be performed in the live site 4 has been completed, each player moves to the printing room 5 while having the ID pyramid. Note that the fortune telling items selected by the participant in the input room 3 are processed simultaneously for each player with the execution of the live site 4.

In the printing room 5 a printing apparatus 23 is disposed. Each player places the ID pyramid on a receiving portion formed in an ID pyramid recovering port of the printing apparatus 23. The system receives the ID of the ID pyramid from the printing apparatus 23 through a communication system to discriminate the player in accordance with the ID. The results of the fortune telling for the player stored in the storage area are transmitted to the printing apparatus 23 in a place to which the ID has been inputted. The results of the fortune telling about the items selected by the participant in the input room 3 and the results of a portion of the fortune telling items performed in the live site 4 are respectively outputted through a port for discharging result indicating paper of the printing apparatus 23. Each player receives the printed paper discharged through the port for discharging result indicating paper of the printing apparatus 23 and leaves the printing room 5 through an exit 6. It should be noted that the printing apparatus 23 has an ID pyramid recovering mechanism so that the ID pyramid is automatically recovered.

Figure 2:
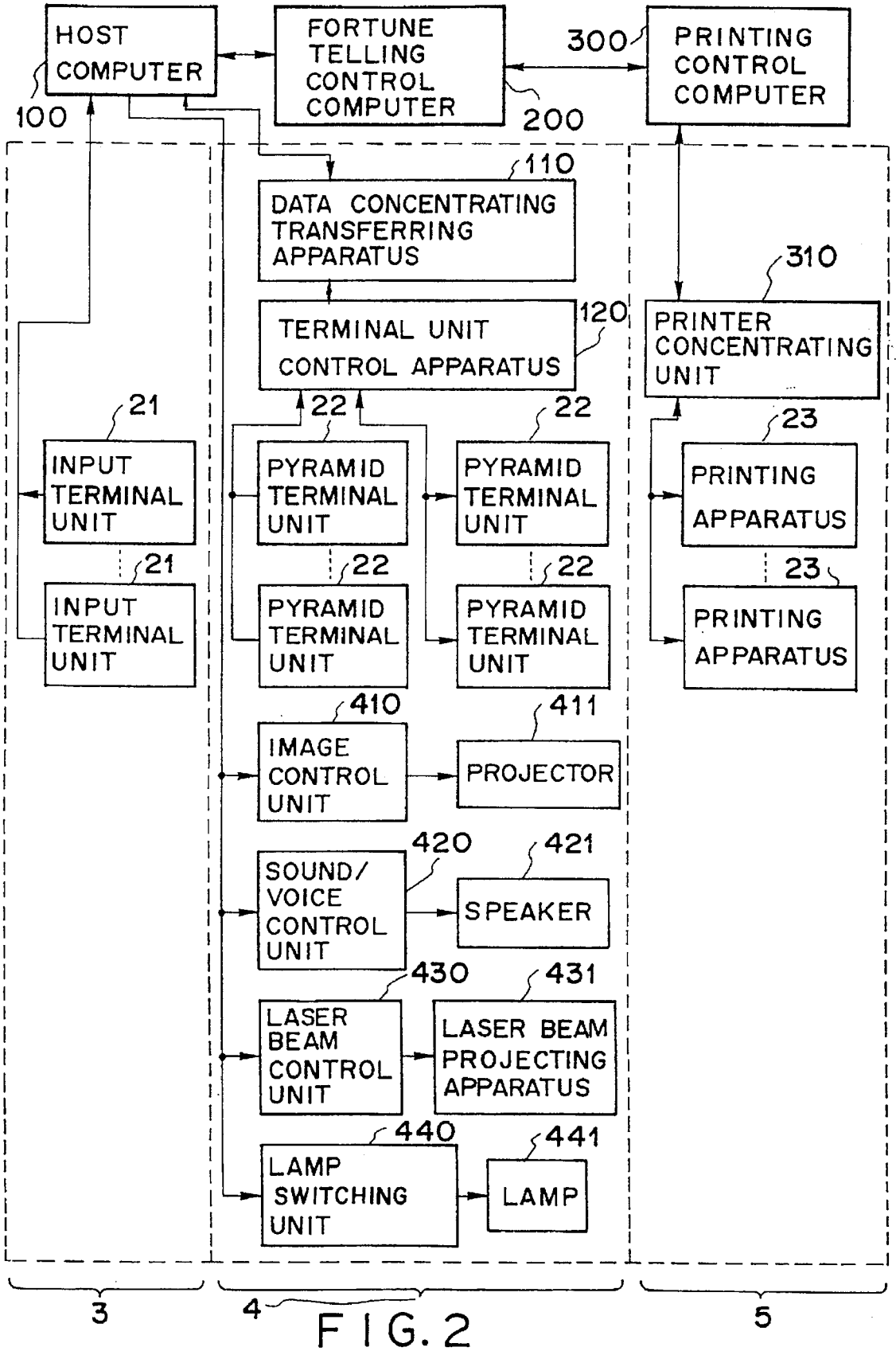
FIG. 2 is a block diagram showing an example of the overall structure of the system according to the present invention.

The construction of the units of the system according to the present invention will now be described. FIG. 2 is a block diagram showing the overall structure of the system according to the present invention. The system is totally controlled by a host computer 100. The execution of the fortune telling is performed by a fortune telling control computer 200, and the output of the result of the executed fortune telling is performed by a printer control computer 300. The computers 100, 200 and 300 are personal computers. The input terminal unit 21 disposed in the live site 4 is connected to the host computer 100, while the pyramid terminal units 22 disposed in the live site 4 are connected to the host computer 100 through a terminal control unit 120 and a data concentrating transferring unit 110.

As stage effect enhancing units in the live site 4, there are disposed a projector 411 for displaying, in the form of images, questions or the like from the player on the curved screen, a speaker 421 for outputting voice and effect sound, a laser beam projector 431 and a lamp 441. The foregoing units are connected to the host computer 100 through an image control unit 410, a sound/voice control unit 420, a laser beam control unit 430 and a lamp switching unit 440. The printing apparatus 23 disposed in the printing room 5 is connected to the printer control computer 300 through a printing data concentrating unit 310.

Figure 3A:
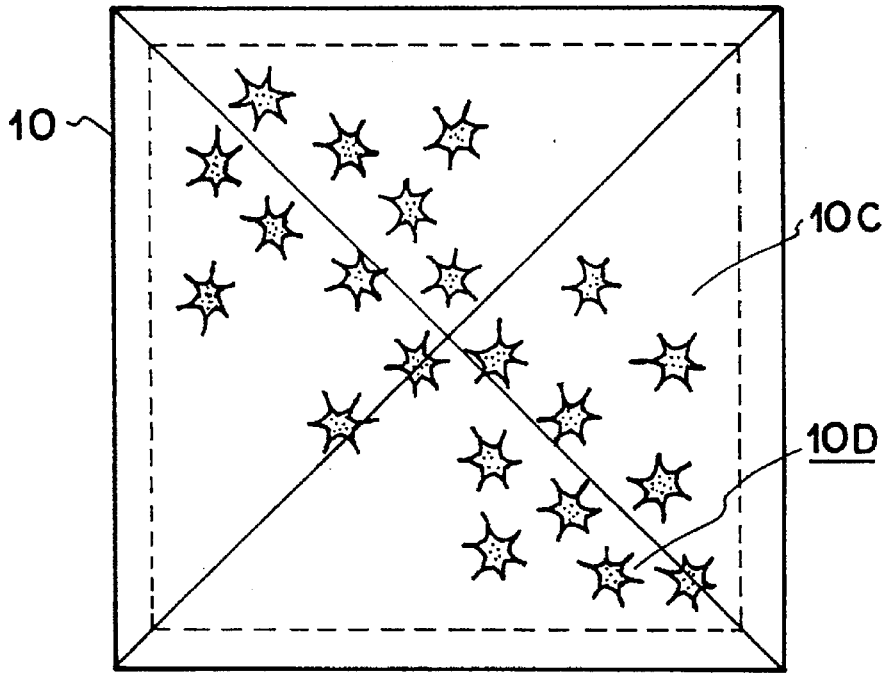
FIGS. 3A and 3B are diagrams showing an example of the structure of an ID pyramid for use in the system according to the present invention.
Figure 3B:
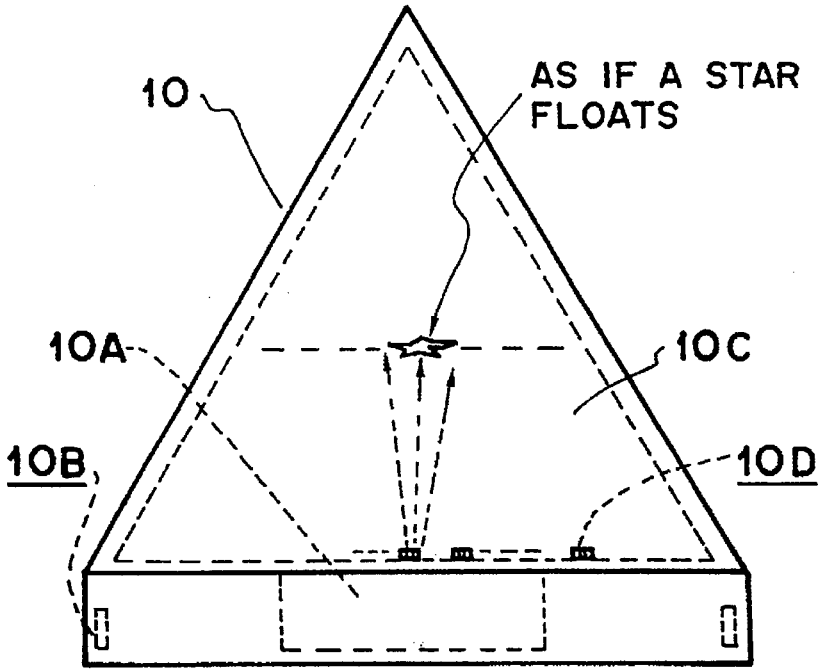

FIGS. 3A and 3B are diagrams showing an example of the structure of the ID pyramid for use in the system according to the present invention. FIG. 3A is a plan view, and FIG. 3B is a side view. The ID pyramid 10 is filled with liquid 10C and has, on the inner wall of the bottom surface thereof, a star pattern 10D so that stars are seen as if they are floating when viewed from an upper position. Furthermore, when the external wall of the bottom surface is irradiated with light, light emits from the inner surface. A fluorescent-color star-shape acrylic resin plate is floating at an intermediate position in the liquid so that the star-shape acrylic resin plate is seen brightly when black light is applied to the star-shape acrylic resin plate. At predetermined positions adjacent to the bottom surface of the ID pyramid 10, an ID 10A and a theft preventing coil 10B are embedded. The ID pyramid 10 may have a size realizing easy portability, for example, length of one side of the illustrated quadrangular prism is 8 cm.

Figure 4:
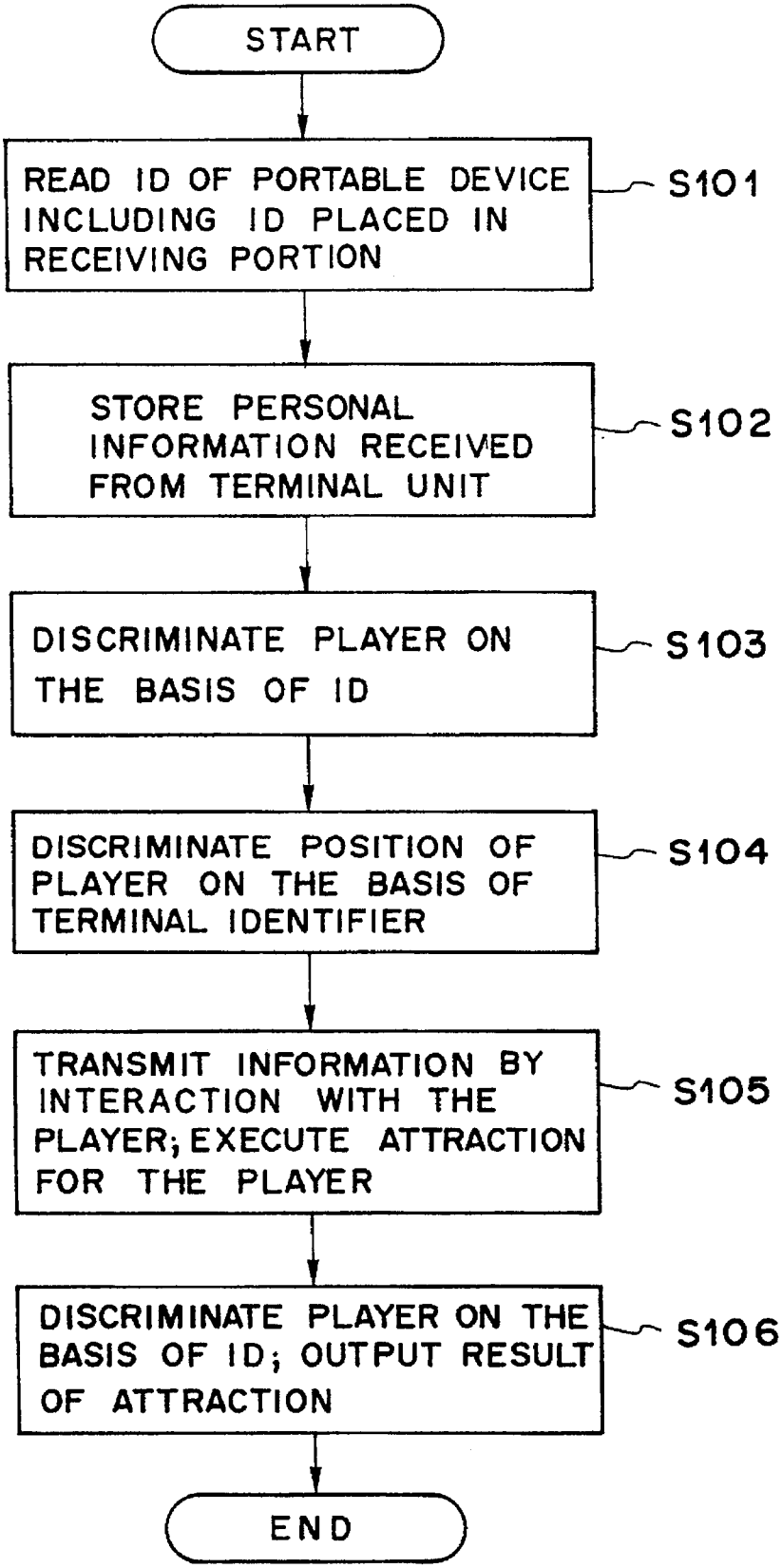
FIG. 4 is a flow chart for explaining a player discriminating process in the system according to the present invention.

A process for discriminating players by using the portable terminal including the ID for use in the system having the foregoing structure according to the present invention will now be described with reference to a flow chart shown in FIG. 4.

Each of the input terminal unit 21, the pyramid terminal unit 22 and the printing apparatus 23 is provided with an ID reading means for reading the ID 10A of the ID pyramid 10 mounted on respective receiving portions. The ID is read by the foregoing terminal units 21, 22 and 23 by a known technology. For example, a resonant ID is used as a non-contact data carrier and the resonance frequency of the resonant ID is detected so as to read the ID (for example, the serial number of the ID pyramid) (Step S101).

The input terminal unit 21 transmits the ID and the inputted personal information to the host computer 100 through the communication system. The host computer 100 stores input information in an information storage area which corresponds to the ID (Step S102). In the live site, which is the main site for the attraction, an ID reading command is transmitted from the host computer 100 to the pyramid terminal unit 22, and the ID of the ID pyramid 10 is received from the pyramid terminal unit 22 through the communication system so that the player is discriminated in accordance with the ID (Step S103). Furthermore, in accordance with disposition information of the pyramid terminal unit registered previously and the identifier of the terminal unit included in the inputted information, the position of the player, that is, the position in the live site, is discriminated (Step S104).

Then, the fortune telling control computer 200 performs the attraction for the player in accordance with personal information stored in the storage means and information about the position of the player. The attraction for the player is performed simultaneously for each of the players. Furthermore, one-to-one bidirectional information transmission is performed to proceed with the attraction while reflecting the inputted information about the player (Step S105). In the printing room, the ID reading command is transmitted from the printer control computer 300 to the printing apparatus 23, and the ID of the ID pyramid 10 is received from the printing apparatus 23 through the communication system, so that the player is discriminated in accordance with the ID. Then, information of the results of the attraction of the player stored to correspond to the ID is read and transmitted to the printing apparatus 23 so that the results are printed on result indicating paper and the operation is completed (Step S106).

The detailed structure and example of the operation of each portion according to the present invention will now be described for each area.

Figure 5A:
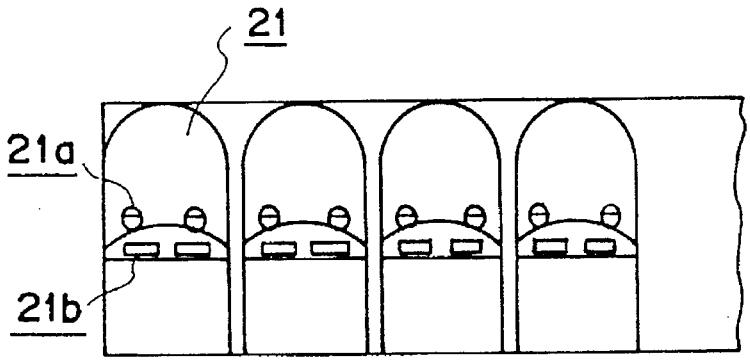
FIG. 5 is a front view showing an example of the shape of input terminal units.
Figure 5B:
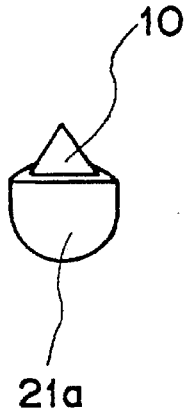

Initially, the input room 3 will now be described. FIG. 5 is a front view showing an example of the shape of the input terminal unit 21 disposed in the input room 3. The input terminal unit 21 is a touch screen type input unit comprising a transparent touch panel placed on the screen of a display unit. As shown in FIG. 5, on the top surface of the housing of the input terminal unit 21, two touch panels 21*b* are adjacently disposed. Furthermore, a receiving portion 21*a* corresponding to each touch panel 21*b* is disposed at each of positions above the two touch panels 21*b*. Although each player is able to use an arbitrary input terminal unit 21, the compatibility between two persons can be told by placing the two ID pyramids 10 on the receiving portions 21*a* disposed adjacently. Input using the input terminal unit 21 is performed by the player by touching characters and pictures on the screen to instruct the contents to be inputted.

Figure 6:
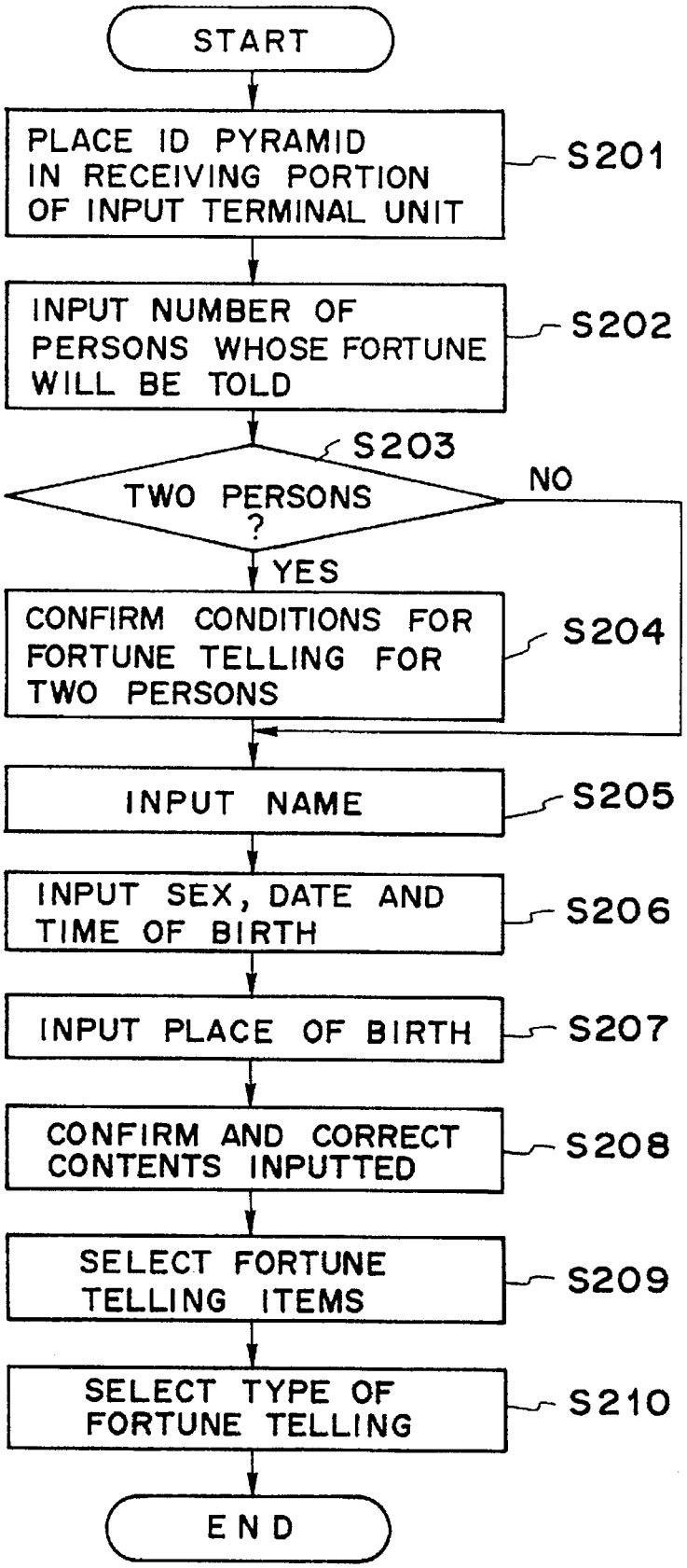
FIG. 6 is a flow chart showing a procedure of inputting personal information and items and type of fortune telling.
Figure 7A:
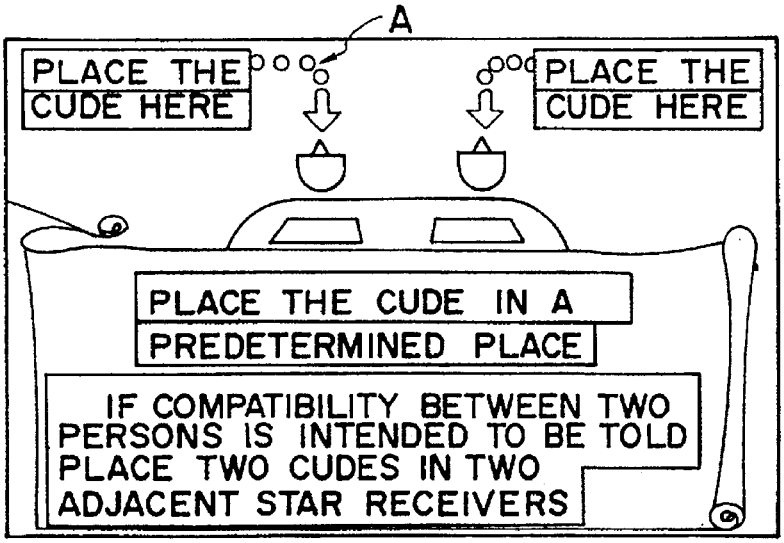
FIGS. 7A to 7C are diagrams showing a specific example of an input guide screen of an input terminal unit.

FIG. 6 is a flow chart showing the procedure of inputting the personal information and item/type of the fortune telling. Referring to the flow chart shown in FIG. 6, a specific example of an input method will now be described. Initially, the player places the ID pyramid 10 in the receiving portion 21*a* in accordance with an input guide screen (hereinafter referred to as an "advertising screen") displayed on the panel 21*b* of the input terminal unit 21 (Step S201). FIG. 7A is a diagram showing an example of the guide screen displayed at the foregoing moment. A schematic view of the input terminal unit 21 is displayed on the screen, and an arrow A is blinked to indicate the position of the placed ID pyramid 10 (it is called as "Cude" in the drawing). When the player places the ID pyramid 10 in the receiving portion 21*a*, the screen is switched to the advertising screen with which the number of persons whose fortune will be told. The player instructs the subject items in accordance with the guide on the advertising screen to input the number of the persons whose fortune will be told (Step S202).

Figure 7B:
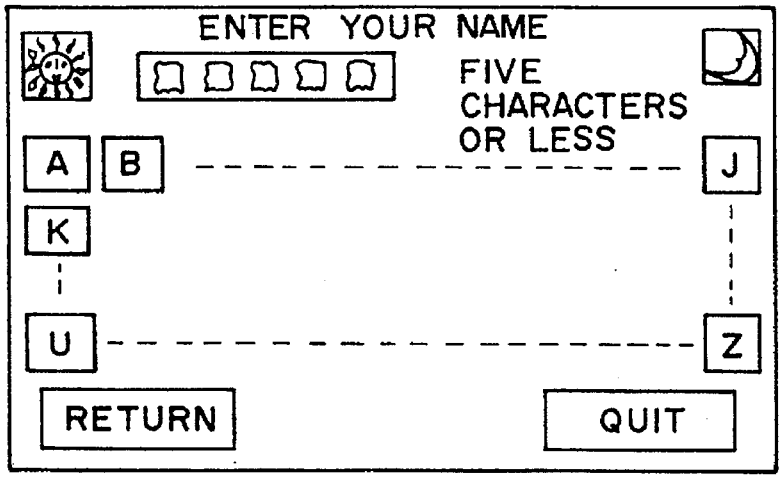

In a case where two persons have been inputted by the player (Step S203), a message is displayed for confirming whether or not the person, the compatibility with which will be told, is the accompanying person. The host computer 100 causes the player to confirm the fortune telling for two persons by means of a fortune telling confirmation message. Furthermore, the host computer 100 checks whether or not the ID pyramid 10 is placed in the adjacent receiving portion by using a detecting sensor. If no subject person is present adjacently, or if the ID pyramid 10 is not placed, a discrimination is made that the conditions are not met and a screen for paying attention is displayed (Step S204). If the conditions are met, an advertising screen for inputting name (see FIG. 7B), is displayed. Then, the player inputs each character of the name of the player in accordance with the guide on the advertising screen. Note that a pattern as indicating a hole is displayed to correspond to the portion in which the instructed character has been written (Step S205).

Figure 7C:
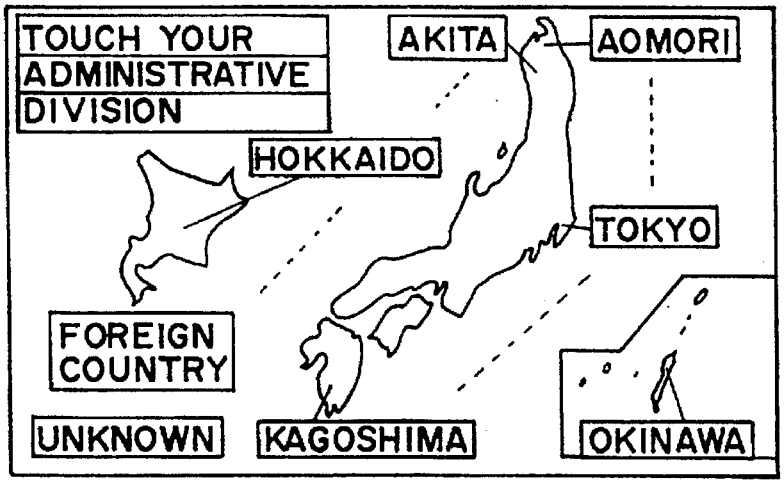

After the name has been inputted, the player inputs the sex, the date and time of birth in accordance with the guide on the advertising screen. If the player does not know the time of birth, it is omitted from inputting. If the player knows the time of the birth in units of minutes, the hour and minute are respectively inputted (Step S206). After the data has been inputted, a map of the country (e.g. Japan) indicating the administrative divisions is, as shown in FIG. 7C, displayed as an advertising screen for inputting the birth place. Therefore, the player instructs the division in which the player has been born. A foreigner inputs "foreign countries", and a player who does not know the birth place thereof inputs "unknown". If the detailed date and place of the birth are not inputted, the position of the heavenly body, such as the planet in the solar system, is calculated on the basis of the reference value in accordance with the inputted information. If the detailed date and place of the birth have been inputted, a further accurate position of the heavenly body can be calculated and accurate results of the fortune telling can be obtained (Step S207).

After inputting of the foregoing personal information has been completed, an advertising screen is displayed to confirm whether or not the inputted contents are correct. If the contents must be corrected, the player instructs the items to be corrected. Since a screen for correcting the instructed items is displayed, the incorrect place is corrected (Step S208). After the inputted contents have been confirmed, the player selects the items and the type of the fortune telling. The type of the fortune telling includes "fortune telling for only the player (fortune telling for one person or that for two persons)" to tell the fortune or the compatibility on the basis of the theory of a horoscope and "interactive type fortune telling common to all players" to be performed in a live site 4 as will be described later. In this description, the fortune telling for only the player is selected which includes the types shown in FIGS. 8A and 8B.

FIGS. 8A and 8B show a list of the fortune telling items for one person or two persons. FIG. 8A shows a specific example of the fortune telling items and types for one person, and FIG. 8B shows a specific example of those for two persons. The fortune telling items indicated as "FIXED" in FIGS. 8A and 8B are fixed fortune telling items that are determined in accordance with the date of birth or the like, while those indicated as "CHANGEABLE" are fortune telling items that occur as time passes, that is, states that are possible to occur.

Figure 9A:
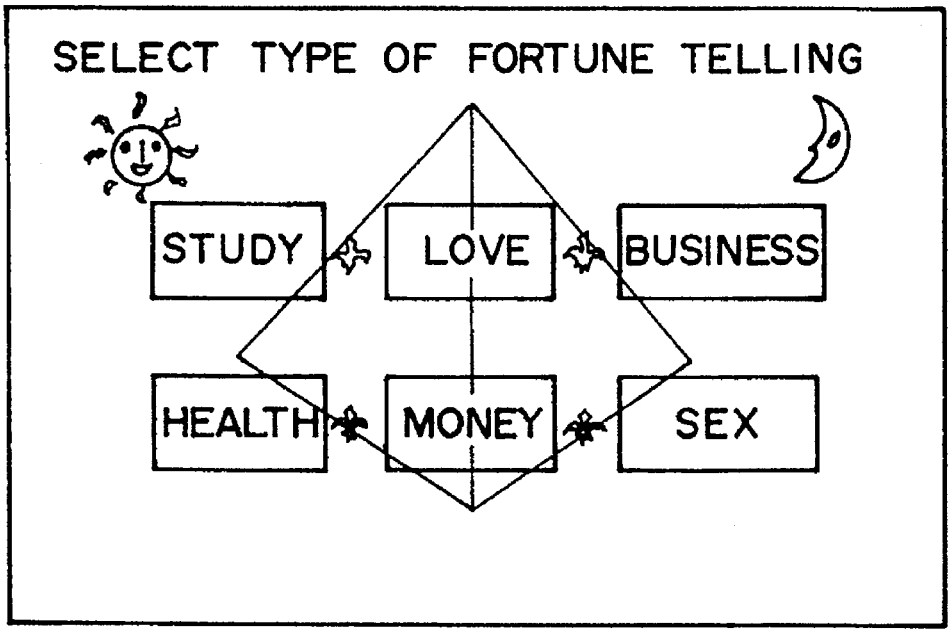
FIGS. 9A and 9B are diagrams showing another specific example of the input guide screen of the input terminal unit.
Figure 9B:
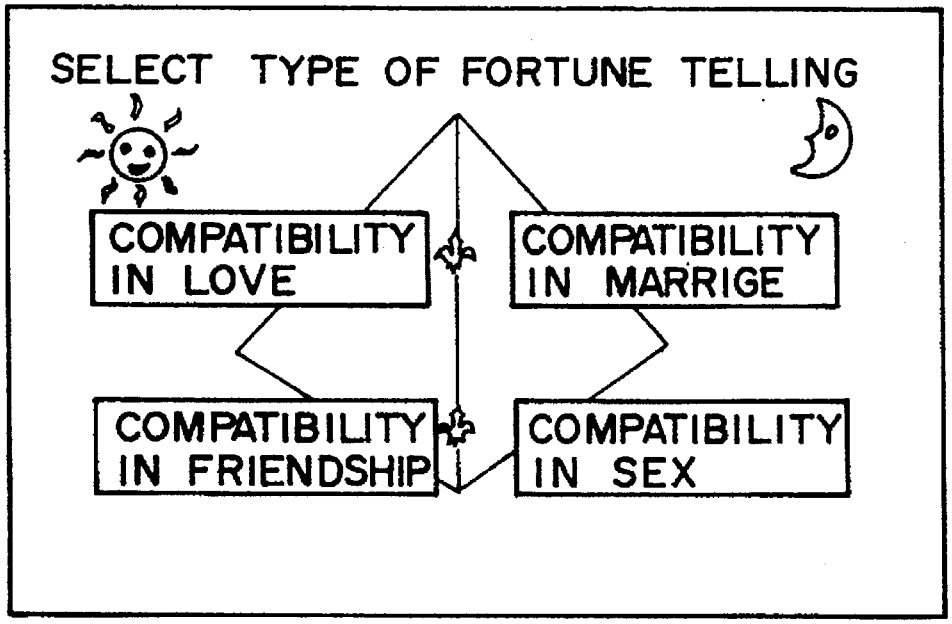

The fortune telling control computer 200 determines the screen to be selected in accordance with the number of persons, to which the fortune will be told, and the age of the player when the screen for selecting the fortune telling items shown in FIGS. 8A and 8B are displayed. That is, the displayed items in the selecting screen are previously set in accordance with ages. In a case where "one person" has been inputted, the selecting screen for one person shown in FIG. 9A is displayed. If the age of the player is lower than "18" at this time, the item "SEX" is excluded from the display. If "two persons" have been inputted, the selecting screen for two persons shown in FIG. 9B is displayed. If the age of the player is lower than 18 at this time, the item "COMPATIBILITY IN SEX " is excluded from the display. As described above, the fortune telling items that are not suitable for the age, for example, the fortune relating to the sex or advise for the fortune, are omitted from displaying on the screen. Each player selects desired items on the advertising screen for selecting the fortune telling items (Step S209). Then, the types corresponding to the selected items are displayed, and therefore the type is selected (Step S210). Thus, the inputting process to be performed in the input room is completed.

The operation to be performed by the system will now he described with reference to FIG. 2, FIGS. 3A and 3B and FIG. 5. During the foregoing inputting process, the input terminal unit 21 reads the ID 10A of the ID pyramid 10 and transmits inputted personal information and selected input fortune telling items, together with the ID 10A, to the host computer 100 through the communication system. The host computer 100 stores the inputted information in the information storage area corresponding to each ID (person). The fortune telling control computer 200 receives an instruction from the host computer 100 and uses the theory of the horoscope so as to perform the fortune telling about the selected type for each player, the results of execution being stored in the information storage area corresponding to each ID. The fortune telling operation is performed by the fortune telling control computer 200 simultaneously with the fortune telling operation which is being performed in the live site 4.

Figure 10:
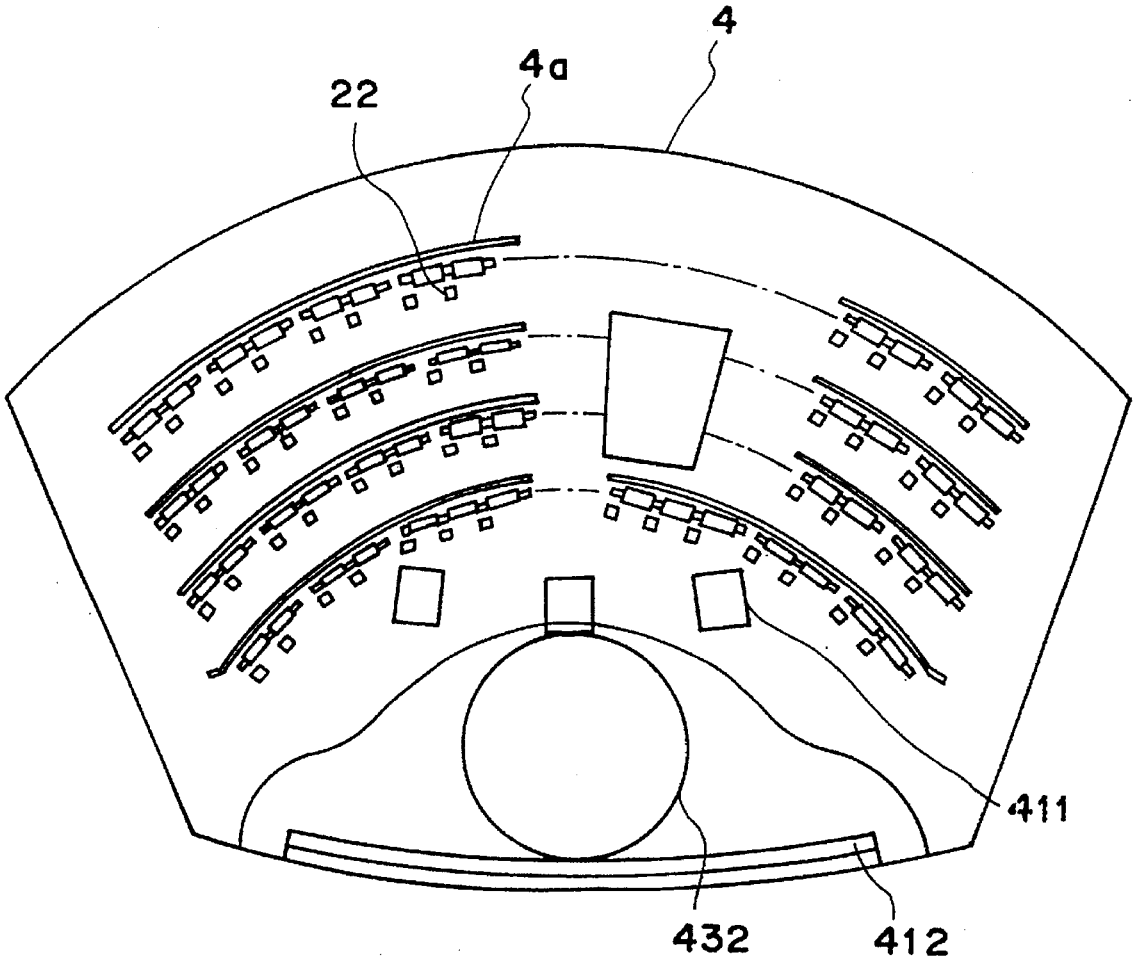
FIG. 10 is a plan view showing the shape of a live site.

The live site 4, which is the main site for the attraction, will now be described. FIG. 10 is a plan view showing the appearance of the live site 4. The live site 4 comprises seats 4*a* disposed such that the front seats 4*a* are disposed lower than the rear seats 4*a*, the seat lines being disposed annularly. The pyramid terminal unit 22 is disposed in front of the seat 4*a* and the pyramid terminal unit 22 has, on the top surface thereof, a receiving portion in which the ID pyramid 10 is placed. In front of the seats 4*a* in the live site 4, the screen 412 on which an image is projected is disposed to enable an image to be projected by using a plurality of projectors 411. The screen 412 comprises a plurality of curved screens disposed adjacently to enable a continuous image to be displayed on the screen 412 by means of a plurality of projectors 411 which project the images on the corresponding curved screen portions. Data of the image to be projected is stored in a laser disk of the image control unit 410 shown in FIG. 2. The image control unit 410 receives a command to output an image issued by the fortune telling control computer 200 to take the subject image data from the laser disk so as to project image screens divided to correspond to the projectors 411 (three projectors in the illustrated example) on the curved screen 412 through the projectors 411.

In front of the curved screen 412, the circular laser beam projecting screen 432 is disposed in such a manner that it is inclined with respect to the floor so as to be seen from all seats. The screen 432 is a stage-effecting screen by means of laser beams. Under control of the laser beam control unit 430 shown in FIG. 2, the laser beam projector 431 emits laser beams so that an image relating to the fortune telling is formed on the circular screen 432. Furthermore, lamps 441 (not shown) are disposed around the circular screen 432 so as to be turned on by the lamp switching unit 440 at the time of stage-effecting using laser beams. Thus, a variety of stage effects can be performed by using the laser beams and lamps 441. In the live site 4, speakers for sound/voice and speakers (not shown) for only outputting effecting sound are disposed so that a comment on the fortune telling, inquiries to the players and effecting sound by means of human's voice are outputted from the respective speakers under control of the sound/voice control unit 420.

The laser beams to be projected to the laser beams projecting screen 432 are not dangerous even if they are applied to a human being. To enhance the safety, a safety apparatus is provided with which laser beams are not applied to human beings if they enter the projecting range for the laser beams. The safety apparatus comprises an invasion detecting means for detecting approach of a human being and a laser beam blocking means which receives a detection signal from the invasion detection means to block the laser beams.

Figure 11:
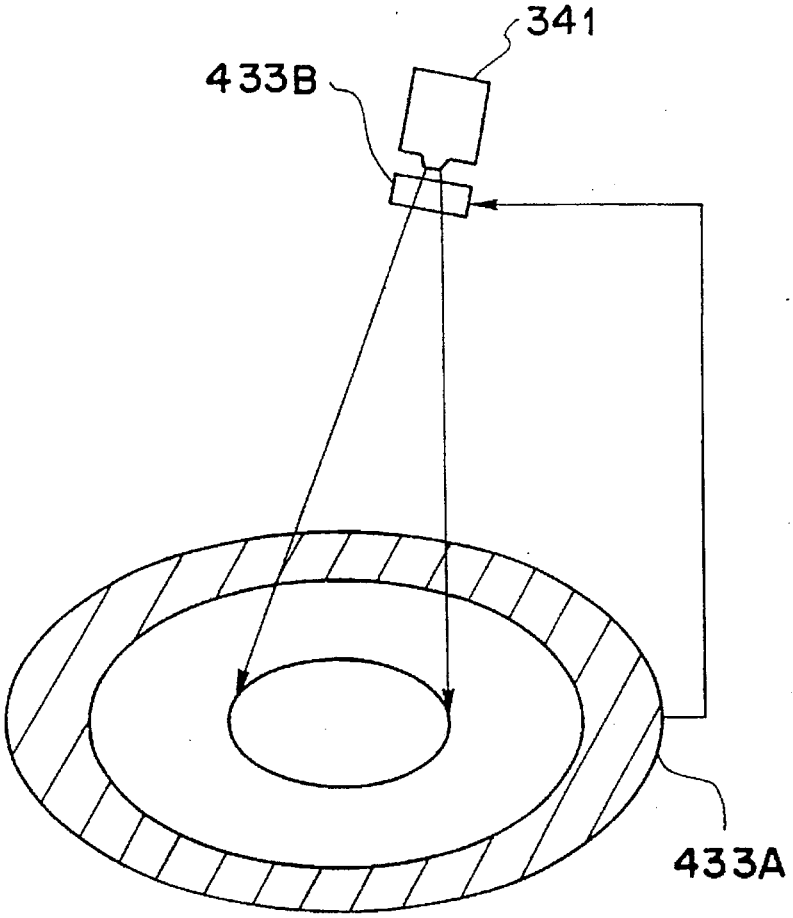
FIG. 11 is a diagram showing an example of the structure of a safety unit for use in the stage effect using laser beams.

FIG. 11 is a diagram showing an example of the structure of the safety apparatus for use in the stage effecting operation using laser beams. As an invasion detecting means 433A, for example, mat switches for use in an automatic door or the like are employed, each mat switch being disposed on the outside of the projecting range. As the laser beam blocking means 433B, for example, a shutter opening/closing apparatus for blocking laser beams is employed. The shutter opening/closing apparatus is disposed at the projecting port of the laser beam projector 341 so that if invasion of a human being is detected by the invasion detecting means 433A, then the shutter opening/closing apparatus is operated to block emitting of laser beams from the projecting port of the laser beam projector 341.

The operation of the thus-constituted safety apparatus 433 will now be described. If a participant approaches the laser beams projecting range, the mat switch serving as the invasion detecting means 433A is switched on, and a signal from the mat switch is supplied to the shutter opening/closing apparatus serving as the laser beam blocking means 433B. The shutter opening/closing apparatus closes the shutter to block laser beams. As a result, participants are protected from being irradiated with laser beams. Note that the invasion detecting means 433A is not limited to the foregoing example structure. For example, invasion may be detected by a human-body detecting sensor or the like. Another structure may be employed from which the laser beam blocking means is excluded and in which a signal from the invasion detecting means 433A is received by the laser beam projector 341 to interrupt the projection of laser beams. In the foregoing case, restarting of the projection of laser beams must be synchronized with the sound output. It is preferable that the safety apparatus has an independent structure.

Figures 12, 20:
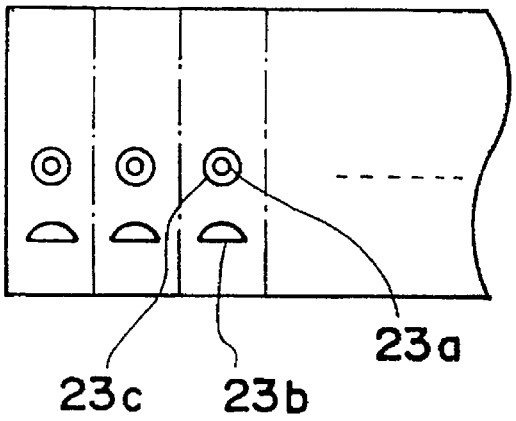
FIG. 12 is a list showing a specific example of the types of the fortune telling to be performed in the live site.
FIG. 20 is a front view showing an example of the shape of a printing apparatus.

Then, a specific example of the fortune telling of an interactive type common to all participants to be performed in the live site 4 will now be described. FIG. 12 is a list showing specific example of the types of fortune telling to be performed in the live site 4. In the live site 4, interactive fortune telling and psychological test shown in FIG. 12 are performed. The interactive fortune telling is performed on the basis of personal information of each player inputted in the input room. The psychological test is performed in such a manner that predetermined inquiry items are made to each player and the test is performed on the basis of the data of answers from each player inputted with respect to the inquiries.

The interactive fortune telling is performed on the basis of a theory of horoscope. The horoscope is a fortune telling method in which the positions of planets, the sun and the moon in the solar system are calculated by an astronomical method and with which the character and fortune of the person are intended to be detected from the coordinates and angles among the heavenly bodies. The fortune telling method is omitted from description.

Figure 13:
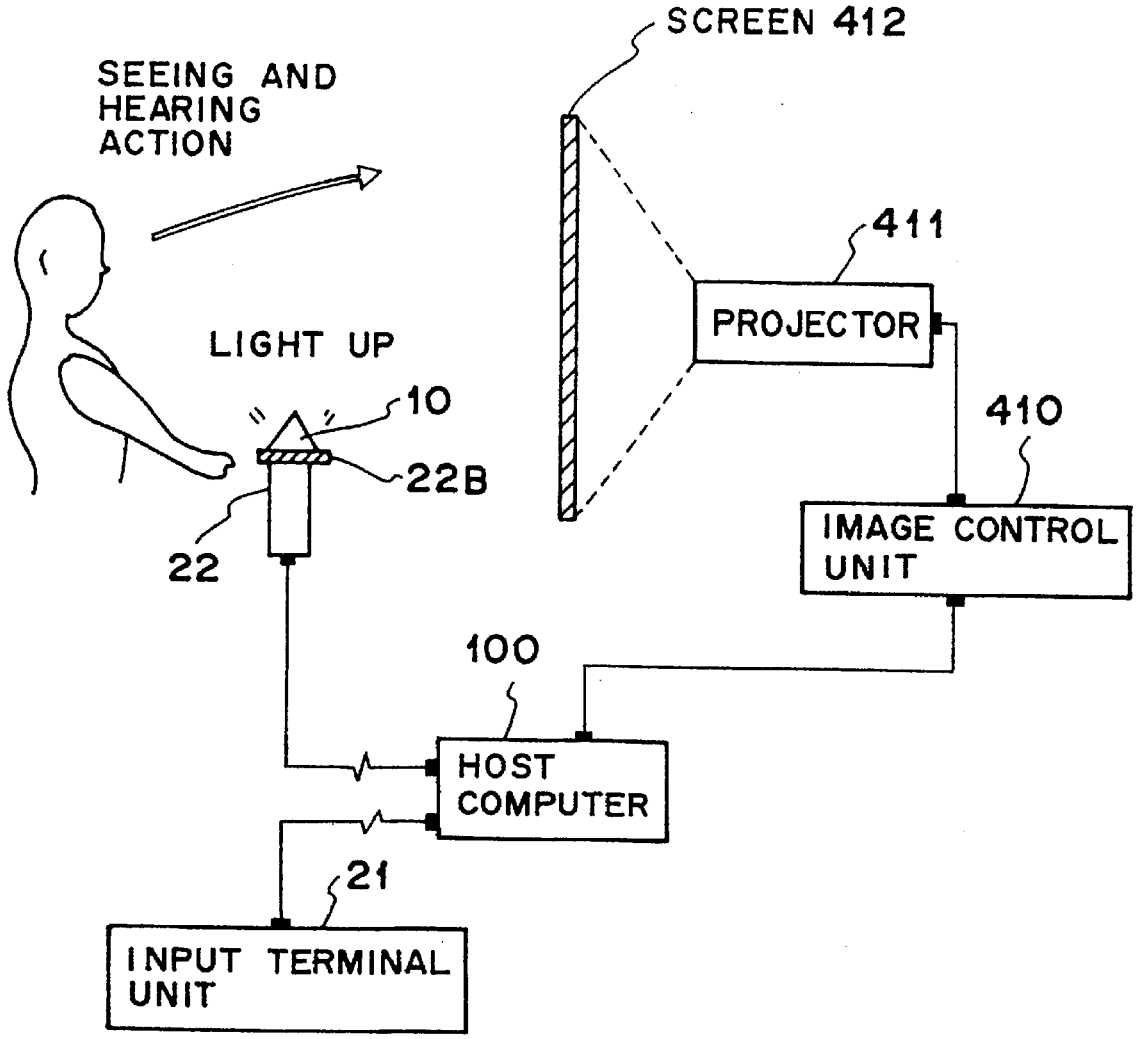
FIG. 13 is a diagram showing a first example of the fortune telling to be performed in the live site.
Figure 14:
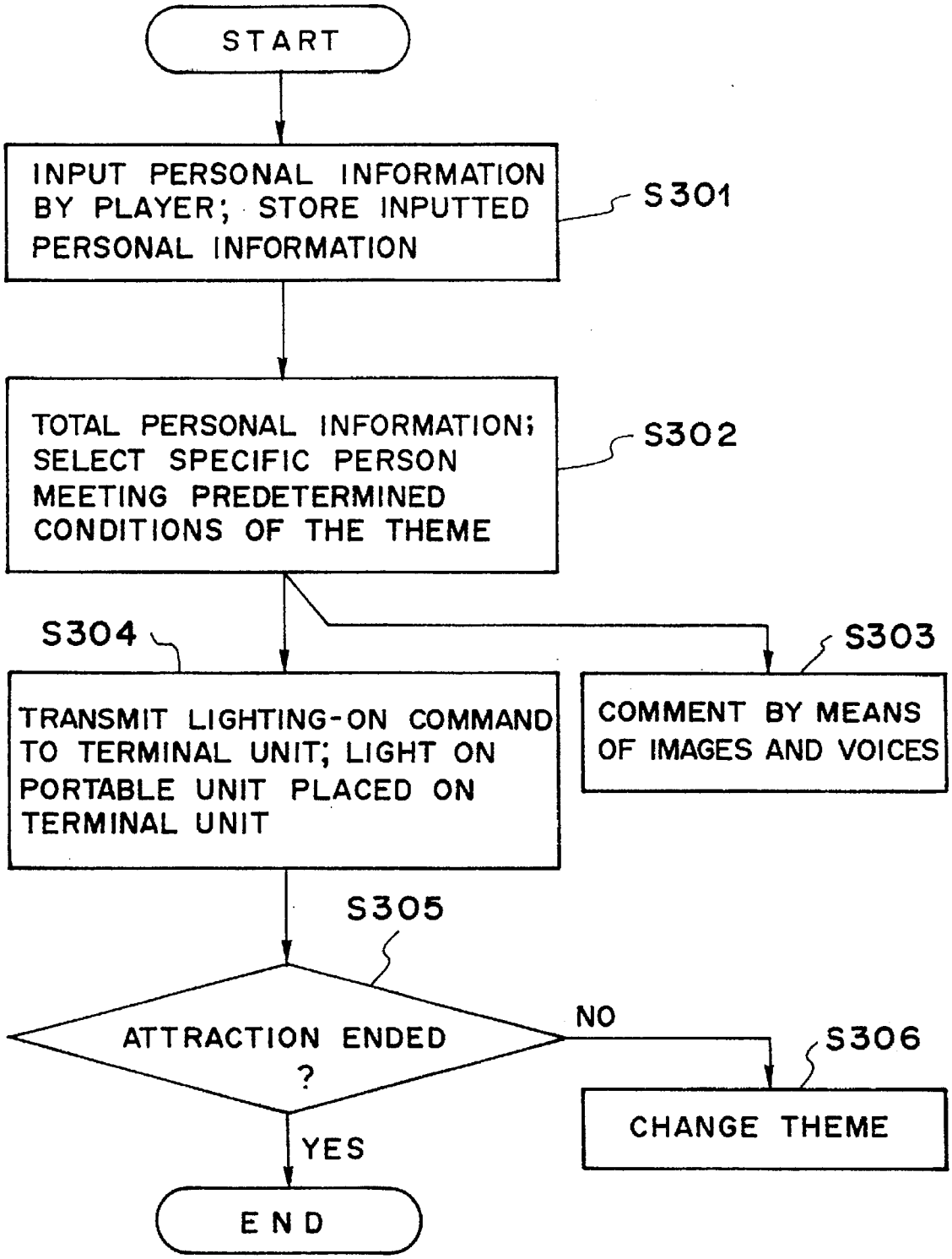
FIG. 14 is a flow chart showing a specific person selecting process to be performed in the system according to the present invention.

A process for selecting a specific person to be performed by the system according to the present invention will now be described with reference to a schematic structural view shown in FIG. 13 and a flow chart shown in FIG. 14 with reference to fortune telling of a type "SUN AND SIGN". Note that voice and sound outputs and stage effect using laser beams are omitted here.

Initially, each player inputs personal information (name, sex, date, time and place of birth) by using the input terminal unit 21. The host computer 100 stores inputted information in the information storage area corresponding to each player (Step S301). The host computer 100 totals the inputted personal information for each player to correspond to the theme or the like of the attraction and selects a specific person from all players that meets predetermined conditions on the basis of the totaled information.

In the type of fortune telling, for example, "SUN AND SIGN" shown in FIG. 12, the subject constellation among the twelve constellations is determined on the basis of the present positional relationship among stars. Then, the positions of stars at the moment of the birth of the player is employed to select players meeting conditions, such that persons whose star is in a favorable position and those having no luck with money. The number of persons has been determined previously and persons meeting the conditions After the selection has been completed, the host computer 100 transmits a command of outputting an image of a comment or the like to the image control unit 410 and transmits a turning-on signal to the pyramid terminal unit 22 of the specific person selected. The image control unit 410, to which the image outputting command has been supplied, reads subject image data from an optical disk on the basis of the image outputting command. Thus, an image is projected on the screen 412 by the projector 411 so as to be commented by means of an image and voice. FIG. 15 shows an example of comments of the results of fortune telling displayed on the screen 412, in which the Bull among the "12" constellations is the subject. The comment of the results of fortune telling as shown in FIG. 15 is projected on the screen 412 after the commencement of the horoscope. The underlined contents of the comments indicated by arrows A and B of FIG. 15 are changed in accordance with the constellation of the "12" constellations (Step S303).

The pyramid terminal unit 22, which has received the turning-on command from the host computer 100, causes the light emitting means 22 (the lamp or the like) to irradiate, with light, the ID pyramid 10 placed in the receiving portion. The ID pyramid 10 is arranged to emit light from the inner surface thereof when irradiated with light. In the example shown in FIG. 2, the overall pyramid body emits light and a bright star floats (Step S304). Then, the theme is changed and the operation returns to the Step S302 (Steps S305 and S306) so that the foregoing process is repeated. After the attraction has been completed, all processes are completed here.

Figure 16:
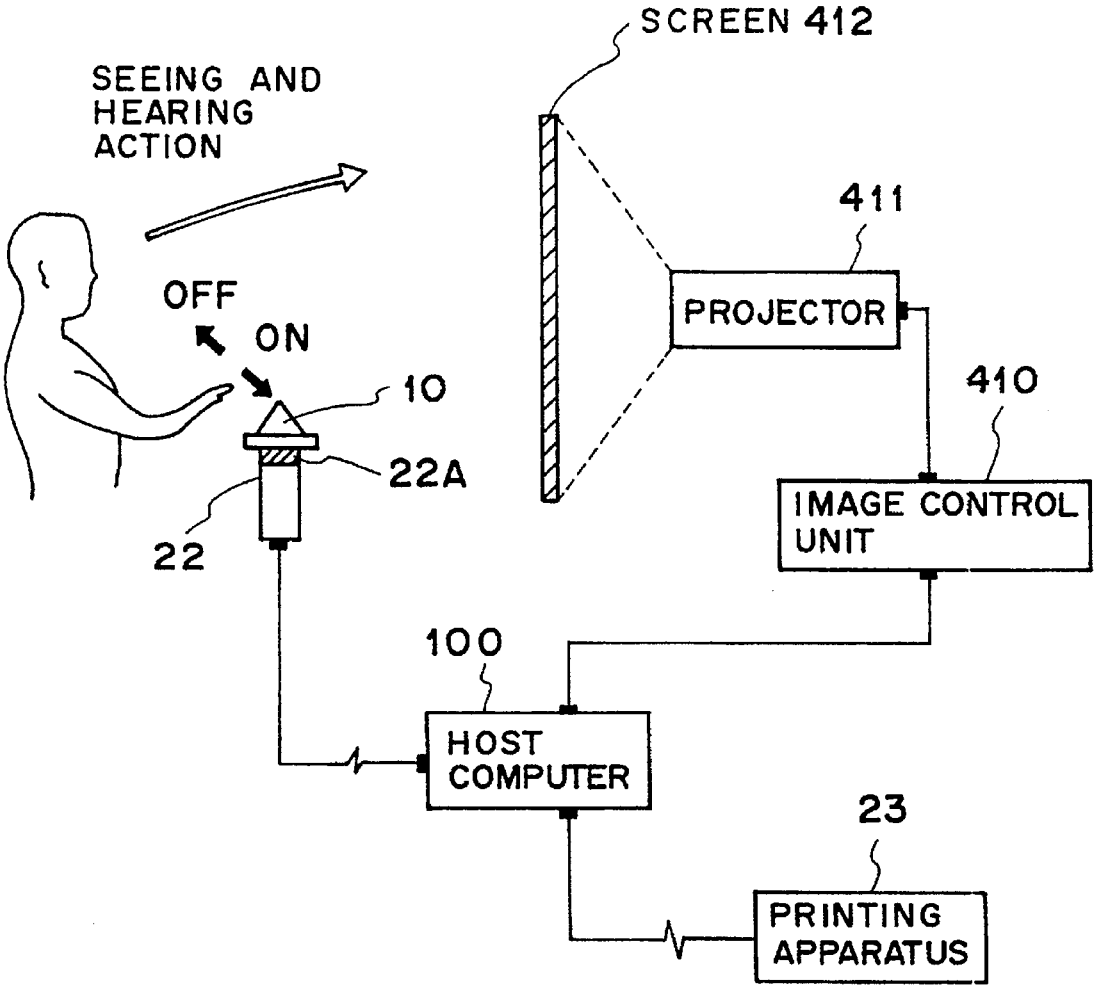
FIG. 16 is a diagram showing a second example of the fortune telling to be performed in the live site.
Figure 17:
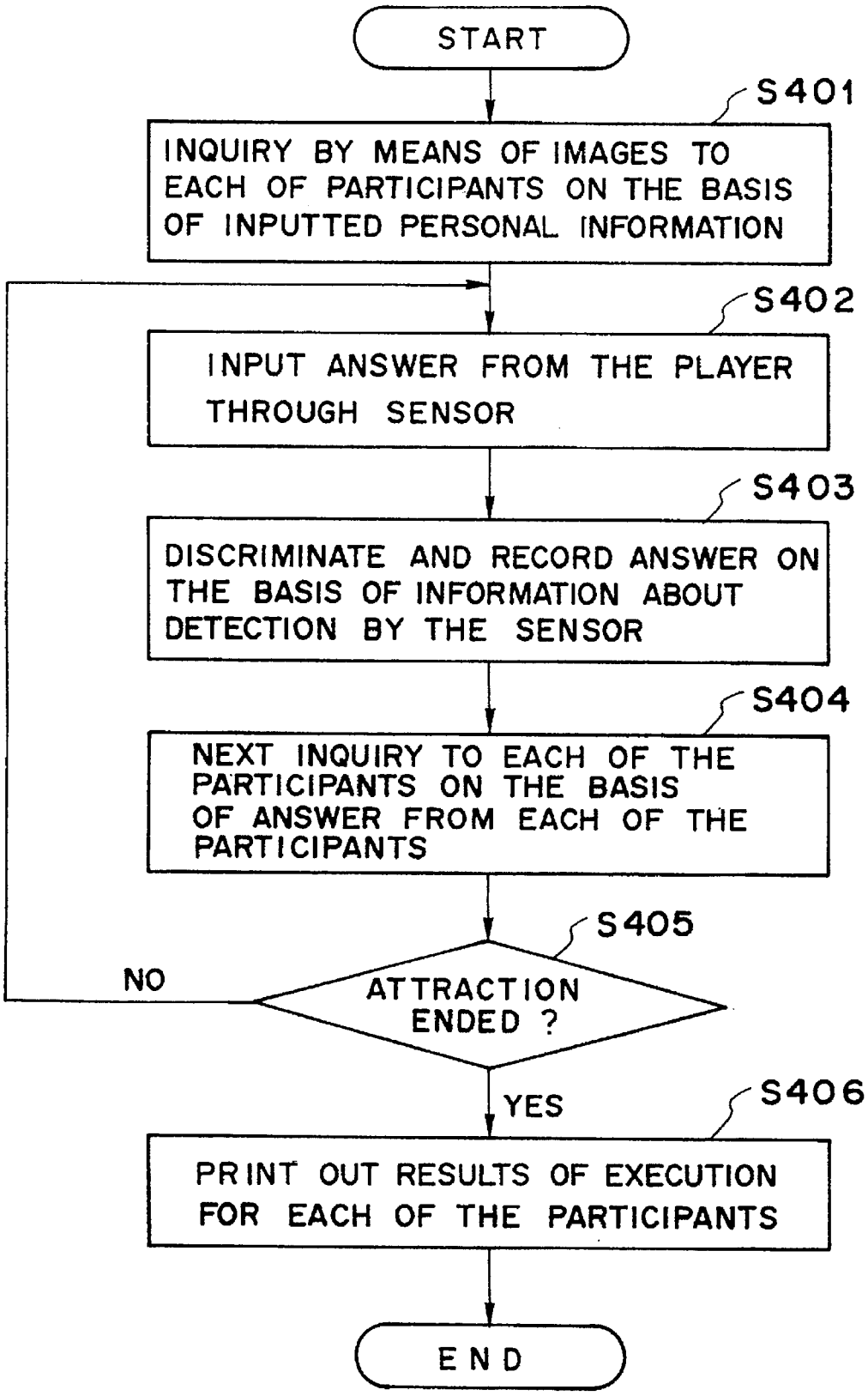
FIG. 17 is a flow chart for explaining an interactive process in the system according to the present invention.

An interactive process to be performed with the system according to the present invention will now be described with reference to a schematic structural view shown in FIG. 16 and in accordance with a flow chart shown in FIG. 17. The host computer 100 initially determines inquiries by means of an image to each of the participants on the basis of the inputted personal information of each participant, and outputs an image outputting command, such as question to the player, to the image control unit 410. The image control unit 410, which has received the image outputting command, reads subject image data from the optical disk on the basis of the image outputting command, and causes the projector 411 to project the image on the screen 412 (Step S401).

The player watches the questions and comments in the form of images or hears the voice to input the answers with respect to the inquiries. The pyramid terminal unit 22 has a sensor (a touch sensor) 22A for detecting whether or not the ID pyramid 10 placed on the receiving portion is touched. The player responds to the inquiry by touching the ID pyramid 10 by the hand. For example, since the questions to be chosen between two are made, the player makes a response by touching it by the hand if the answer is "YES". The player does not touch the ID pyramid 10 if the answer is "NO" (Step S402).

The pyramid terminal unit 22 transmits information detected by the sensor 22A to the host computer 100. The host computer 100 discriminates the answer of the player on the basis of the detected information. In a case where detected information is inputted within a predetermined time after a question has been transmitted to the pyramid terminal unit 22, discrimination "YES" is performed. The answer of the subject player is recorded (Step S403). If the answers of all questions made by one image display operation have been received, a next inquiry to each participant is determined on the basis of the answer from each player, and an image outputting command is transmitted to the image control unit 410. The next inquiry is determined such that a variety of inquiries are previously registered in the form of a tree structure and branching is performed on the basis of the answers (Step S404). Then, the operation returns to the Step S402, so that the foregoing process is repeated. If the attraction has been completed, the results of execution made for each of the participants are outputted to the printing apparatus 23 (Steps S405 and S406), and all processes are completed here.

Then, the foregoing interactive process will now be described with reference to a schematic structural view shown in FIG. 16 while taking a type of fortune telling "VIEW OF LIFE" of the psychological test as a specific example. Note that the psychological test is included in the category of the fortune telling according to the present invention. In the psychological test about the "VIEW OF LIFE", inquiry items as shown in FIG. 18 are sequentially displayed on the screen, and each player looks the questions and comments in the form of images or hears the voice of the same to input the answers of the inquiries. The player responds to the inquiries by touching the portion adjacent to the apex of the ID pyramid 10 placed in the receiving portion of the pyramid terminal unit 22.

If the answer "YES" is made with respect to the inquiry shown in FIG. 18, the player touches the ID pyramid 10 by the hand. If the answer "NO" is made, the player does not touch the ID pyramid 10. That is, the player answers the inquiry by choice between two, that is, touch or do not touch. The pyramid terminal unit 22 transmits information detected by the sensor 22A to the host computer 100. The host computer 100 discriminates the answer of the player on the basis of the detected information. In a case where detected information is inputted within a predetermined time after a question has been outputted to the pyramid terminal unit 22, discrimination "YES" is made, and the answer of the player is recorded. Then, whether or not the answer with respect to the question has been made is checked. If answers from all participants have been received or if a predetermined time has passed from the display of the question, a next question is displayed and the foregoing process is repeated until the final question is made. If all answers are received, fortune telling for each player is performed on the basis of the answer from each player. The fortune telling is performed by the fortune telling control computer 200. The results of the psychological test are, under control of the printing control computer 300, outputted together with results of other fortune telling in the printing room.

The psychological test has a plurality of patterns as shown in FIG. 12, and the pattern to be executed is determined in accordance with the time zone. For example, pattern 1 (type: "VIEW OF LIFE") is performed from 10:00 AM, pattern 2 (type: "VIEW OF LOVE") is performed from 1:00 PM, and pattern 3 (type: "SEXUAL INTEREST") is performed from 6:00 PM. Although the above-mentioned example of the psychological test has predetermined inquiry items, another fortune telling of a type, in which a next inquiry to each player is determined on the basis of the answer from each player, is performed. That is, after all answers of the first question have been received, the host computer 100 determines a next inquiry on the basis of the answer from each player and outputs a next image outputting command to the image control unit 410. The next inquiry is determined such that a variety of inquiries are previously registered in the form of a tree structure and branching is performed on the basis of the answers. The foregoing bidirectional interactive type fortune telling is performed in the live site.

Figure 19A:
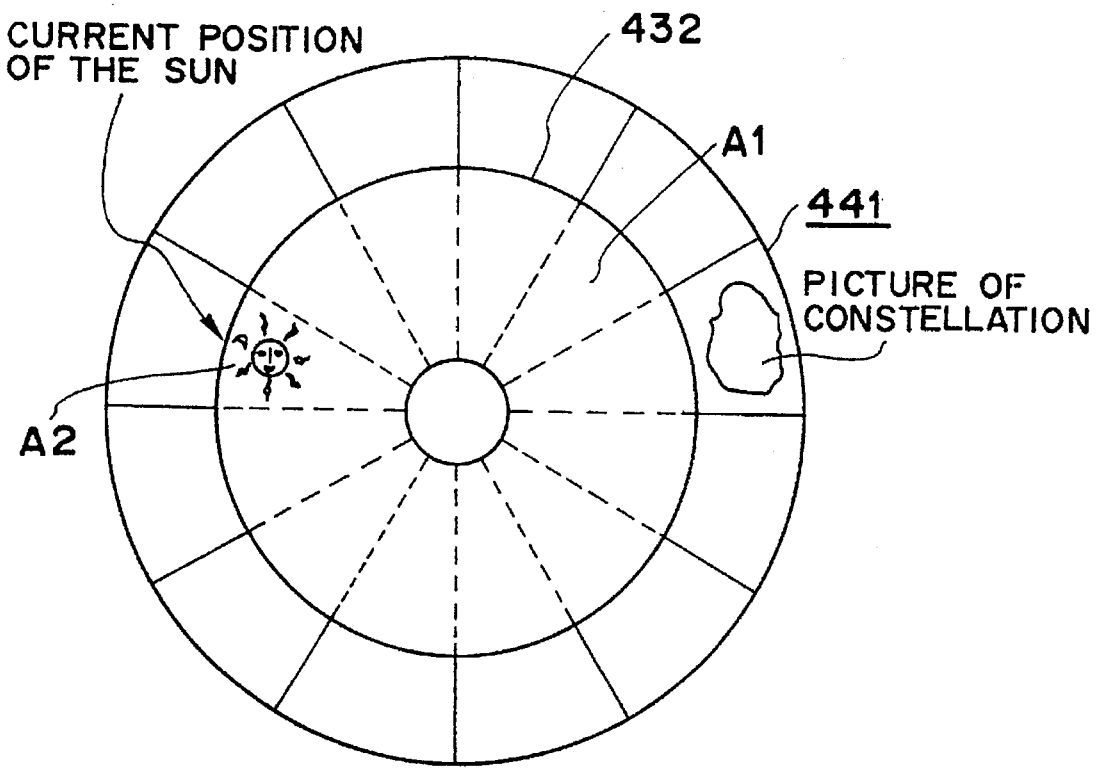
FIGS. 19A and 19B show an example of an image formed on a laser beam projecting screen in the live site.
Figure 19B:
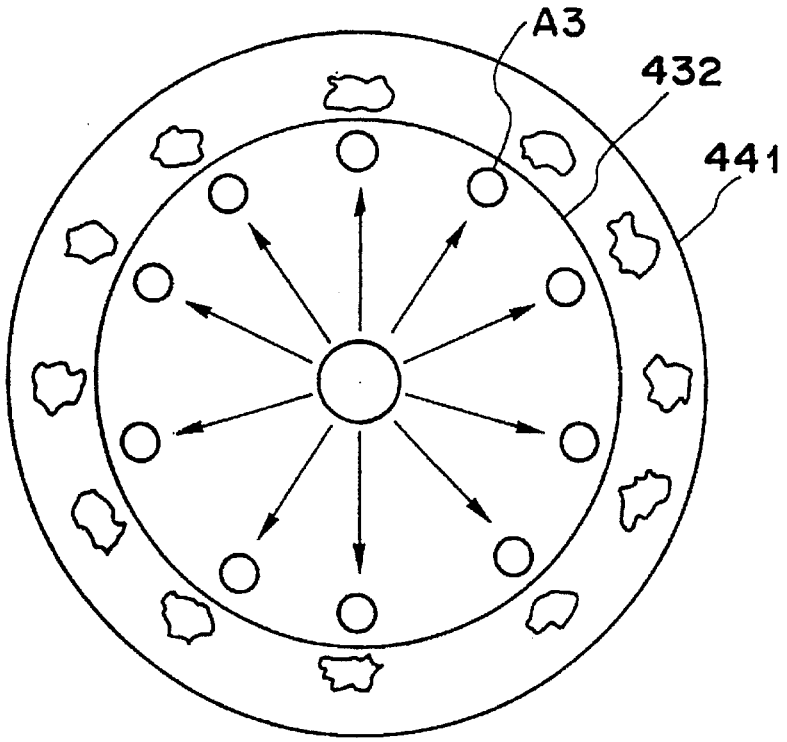

A specific example of stage effect enhancement using the laser beams to be performed in the live site will now be described. The stage effect enhancement using laser beams is performed by combining images and sound effects. A stage effect using light will now be described. FIGS. 19A and 19B show an example of an image formed on the laser beam projecting screen, in which an example of display to be performed when the fortune telling of a type "SUN AND SIGN" of the interactive fortune telling is shown. FIG. 19A shows an example in which horoscope (circular chart) A1 is formed on the laser beam projecting screen 432 and a pattern A2 of the sun is drawn at the present position of the sun obtained by calculation. Note that the lamps 441 disposed around the laser beam projecting screen 432 have the "12" constellations previously drawn at the light emitting portion thereof so as to project the constellation when the lamps 441 emit light.

FIG. 19B shows an example of display when the stage effect is enhanced by using both lamps 441 and the laser beam projector 431, in which a stage effect is enhanced such that planets A3 circulate at random, gradually gathered on a concentric circle, and the planets A3 are equally expelled. After planets A3 have been expelled in directions indicated by arrows, the lamps 441 are caused to simultaneously flicker. At this time, effect sounds are produced in synchronization with the operation of the laser beams. In addition to the foregoing display pattern, a variety of display patterns are prepared so that a variety of stage effects are produced which are suitable for the contents of the fortune telling performed in the live site. After all fortune telling operations in the live site have been completed, the host computer 100 outputs a message in the form of images and voice for guiding the participant to the printing room called a "divine guidance room", and the fortune telling process in the live site is completed.

Then, the printing room 5 will now be described. FIG. 20 is a front view showing an example of the shape of the printing apparatus disposed in the printing room 5. A result-paper discharge port 23*b*, to which result paper indicating detailed results of the fortune telling is discharged, is formed below a pyramid recovery port 23*c* for recovering the ID pyramid 10. In the pyramid recovery port 23*c*, a portion 23*a* for receiving the ID pyramid 10 is formed. The ID pyramid 10 placed in the ID pyramid receiving portion 23*a* is recovered by a recovery mechanism. The recovery mechanism comprises a conveying means (for example, a belt conveyor) for conveying the ID pyramid 10 and an arranging means (for example, a guide member and a storage box) for arranging the ID pyramid 10 conveyed by the conveying means.

An example of the operation of the thus-arranged structure will now be described with reference to FIG. 2. When the player places the ID pyramid 10 in the ID pyramid receiving portion 23*a*, the ID of the ID pyramid 10 is read by the printing apparatus 23 and is transmitted to the printing control computer 300 through the communication system. The printing control computer 300 discriminates the player in accordance with the ID and takes the result of execution of the player stored in the storage area so as to output the result to the printing apparatus 23 in a place to which the ID has been inputted. At the moment when the ID pyramid 10 has been placed, conveyance of each ID pyramid starts by the conveying means to a recovery portion at the reception and arranged and stored in a storage portion by the arranging means.

In the vicinity of the exit of the printing room, a theft prevention detection means for preventing theft of the ID pyramid 10 is disposed. The theft prevention detection means comprises a sensor for detecting a signal from the theft preventing coil provided for the ID pyramid 10 and a voice output apparatus for outputting a voice alarm. When the signal from the theft preventing coil is detected, a voice alarm is issued.

As described above, the fortune telling system according to the present invention has the arrangement that fortune telling for only the player is performed in accordance with personal information inputted in the input room, and while the fortune telling is being performed, fortune telling common to participants is performed in the live site. In the live site, inquiry is made by means of images by using a curved screen, each player touches the ID pyramid by the hand to input answer, and fortune telling is performed on the basis of the answer. During execution of the fortune telling, players are able to enjoy various stage effects while watching images projected on the curved screen and pictures formed on a circular screen by means of laser beams and hearing voice comments and effect sound. In the live site, peculiar fortune telling is performed on the basis of personal information of each player as well as the foregoing interactive type fortune telling. That is, since the seats and corresponding players can be discriminated on the basis of the ID of the ID pyramid, fortune telling is performed on the basis of totaled personal information, and a player meeting predetermined conditions is selected from many players, and selection can be notified to the selected player by lighting up the ID pyramid.

Therefore, each player is able to enjoy various fortune telling with a variety of stage effects as well as enjoying seeing images. Since different fortune telling is performed each day, players are able to enjoy the attraction system repeatedly. Hence, the repeating ratio can be raised. Since multiperson fortune telling is performed in the live site, the player can be excited in terms of stage effects. Since also fortune telling of a type determining next inquiries to each of participants on the basis of totaled personal information and information of answer of each player with respect to inquiries can be performed, interactive fortune telling can be provided in which each player and the system mutually affect and the contents of execution and those to be displayed are changed.

With the player discriminating method in the attraction system according to the present invention, a simple operation of the player to place the portable terminal including ID at a predetermined place is required to automatically discriminate the player. When a player performs a certain operation, the operation and the player can be discriminated. Furthermore, one-to-one bidirectional information transmission for each player is performed so that an attraction for the player is performed in such a manner that information from the player is reflected.

The attraction system having a function of selecting a specific person according to the present invention is able to select a specific person, who meets predetermined conditions of the theme of the attraction, from the participants on the basis of inputted personal information of each player (participant). Therefore, inputted information of each player can be reflected on the contents of execution of the attraction and each player is provided with a feeling of participating in the attraction. For example, if the foregoing attraction system is applied to a fortune telling system, then fortune telling variation can be increased, different fortune telling can be performed each day, and the multiperson fortune telling produces an effect of exciting the players.

Since the specific person is selected from a multiplicity of persons and the notification is made in the place where the selection has been performed, the player is able to enjoy the attraction system because the player is tensed up. Since the contents of the attraction is varied at each time, the player is able to repeatedly enjoy the attraction of the system. In addition, the fact of selection is notified by lighting the portable terminal of the player as well as images and sound. Therefore, the stage effect can be enhanced.

The interactive type attraction system according to the present invention enables a multiplicity of players to input answers while looking at images, and enables inputted information of each player to be reflected on the contents of execution of the attraction. Therefore, each player is provided with a feeling of participating in the attraction. Since the contents of the attraction can be varied each time, the player is able to repeatedly enjoy the attraction, thus improving the repeating ratio. Since an answer is inputted by the player by touching the portable terminal carried by the player, a psychological effect can be produced if the system is applied to a fortune telling system or the like.

As compared with the conventional multiperson participating attraction system in which the player watches the image in the attraction site and enjoying the attraction is completed in the site, the system according to the present invention has the arrangement that the player answers inquiries while watching images and the result can be received as printed paper. A variety of enjoyment can be realized. If the system is applied to a fortune telling system, the contents of inquiries relating to the fortune telling are determined on the basis of the date of execution and inputted information of the player. Therefore, the contents and results are varied each day and the fortune telling operation can be varied. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An attraction for multiperson participation comprising:

a path along which a plurality of participants may move, the path including first and second areas located therealong;

a plurality of identification devices transportable along the path by the participants, each of the identification devices including a unique identification element;

a plurality of first input means located in the first area, each of the first input means including a receiving portion for receiving an identification device placed thereon;

means for reading the identification element of the identification device placed on the receiving portion of the first input means;

information input means for allowing a participant to enter information describing that particular participant; and first information transmission means for transmitting information entered by the participant and information corresponding to the identification element;

a primary display apparatus located in the second area and common to all of the participants located in the second area, the display apparatus providing visual information to each of the participants located in the second area;

a plurality of second input means located in the second area, each of the second input means including a receiving portion for receiving an identification device placed thereon;

means for reading the identification element of the identification device placed on the receiving portion of the second input means; and second information transmission means for transmitting information corresponding to the identification element; and control means for receiving the information from each of the first and second information transmission means, and for controlling the operations of the plurality of first input means, the plurality of second input means, and the primary display apparatus, the control means controlling the primary display apparatus based on the information received from each of the first and second information transmission means.

2. The attraction for multiperson participation according to claim 1, wherein the second input means further includes sensor means for detecting a response signal provided by the participant.

3. The attraction for multiperson participation according to claim 2, wherein the sensor means detects contact of a participants hand with the identification device when the identification device is located in the receiving portion of the second input means.

4. The attraction for multiperson participation according to claim 3, wherein the second information transmission means transmits information received by the sensor means to the control means.

5. The attraction for multiperson participation according to claim 1, wherein the second area further includes a sound reproduction device controlled by the control means, the sound reproduction device outputting voice and sound effects in accordance with instructions received from the control means.

6. The attraction for multiperson participation according to claim 1, wherein the primary display apparatus includes a screen and image projecting means for projecting images onto the screen.

7. The attraction for multiperson participation according to claim 6, wherein the screen is curved, and wherein the image projecting means includes a plurality of projectors each projecting a portion of one combined image onto the curved screen to form the combined image.

8. The attraction for multiperson participation according to claim 1, wherein the primary display apparatus includes a circular screen and laser projecting means for projecting a laser beam onto the circular screen.

9. The attraction for multiperson participation according to claim 8, further including, a plurality of illumination devices disposed around the circular screen; and illumination control means for selectively illuminating each of the plurality of illumination devices.

10. The attraction for multiperson participation according to claim 8, wherein the laser projecting means includes safety override means for detecting the presence of a participant in an area in which the laser beam is projected.

11. The attraction for multiperson participation according to claim 10, wherein the safety override means includes blocking means for blocking the laser beam projected by the laser projecting means.

12. The attraction for multiperson participation according to claim 1, wherein each of the plurality of identification devices includes a theft prevention element, and wherein the attraction further includes theft prevention element detecting means located in the vicinity of an exit of the attraction; and alarm means for producing an alarm signal upon detection of a theft prevention element by the theft prevention element detecting means.

13. The attraction for multiperson participation according to claim 1, wherein the path further includes a third area located therealong, the third area including a plurality of printing means, each of the printing means including a receiving portion for receiving an identification device placed thereon;

means for reading the identification element of the identification device placed on the receiving portion of the printing means; and means for printing information specific to the particular participant in response to identification of the particular participant by reading of the identification element.

14. The attraction for multiperson participation according to claim 1, wherein each of the second input means further includes irradiating means for irradiating the identification device placed on the receiving portion of the second input means, the identification device emitting light from an inner surface thereof when irradiated by the irradiating means.

15. The attraction for multiperson participation according to claim 14, further including irradiation control means for collecting information received from the first input means, for selecting a particular participant from the plurality of participants, and for selectively illuminating one of the irradiating means corresponding to the location of that particular participant.

16. The attraction for multiperson participation according to claim 1, wherein the second area further includes a sound reproduction device controlled by the control means, the sound reproduction device outputting voice and sound effects in accordance with instructions received from the control means, and wherein the primary display apparatus includes a curved screen and a plurality of projectors each projecting a portion of one combined image onto the curved screen to form the combined image.

17. The attraction for multiperson participation according to claim 16, wherein the primary display apparatus further includes a circular screen and laser projecting means for projecting a laser beam onto the circular screen.

18. The attraction for multiperson participation according to claim 17, further including a plurality of illumination devices disposed around the circular screen; and illumination control means for selectively illuminating each of the plurality of illumination devices.

19. The attraction for multiperson participation according to claim 17, wherein the laser projecting means includes safety override means for detecting the presence of a participant in an area in which the laser beam is projected, the safety override means including blocking means for blocking the laser beam projected by the laser projecting means.

20. The attraction for multiperson participation according to claim 19, further including a plurality of illumination devices disposed around the circular screen; and illumination control means for selectively illuminating each of the plurality of illumination devices.

21. The attraction for multiperson participation according to claim 20, wherein each of the plurality of identification devices includes a theft prevention element, wherein the attraction further includes theft prevention element detecting means located in the vicinity of an exit of the attraction, and alarm means for producing an alarm signal upon detection of a theft prevention element by the theft prevention element detecting means, and wherein the path further includes a third area located therealong, the third area including a plurality of printing means, each of the printing means including a receiving portion for receiving an identification device placed thereon;

means for reading the identification element of the identification device placed on the receiving portion of the printing means; and means for printing information specific to the particular participant in response to identification of the particular participant by reading of the identification element.

22. The attraction for multiperson participation according to claim 21, wherein the second input means further includes sensor means for detecting contact of a participants hand with the identification device when the identification device is located in the receiving portion of the second input means; and irradiating means for irradiating the identification device placed on the receiving portion of the second input means.

23. The attraction for multiperson participation according to claim 1, wherein the second input means further includes sensor means for detecting contact of a participants hand with the identification device when the identification device is located in the receiving portion of the second input means; and irradiating means for irradiating the identification device placed on the receiving portion of the second input means.

24. The attraction for multiperson participation according to claim 1, wherein each of the plurality of identification devices includes a theft prevention element, wherein the attraction further includes theft prevention element detecting means located in the vicinity of an exit of the attraction, and alarm means for producing an alarm signal upon detection of a theft prevention element by the theft prevention element detecting means, and wherein the path further includes a third area located therealong, the third area including a plurality of printing means, each of the printing means including a receiving portion for receiving an identification device placed thereon;

means for reading the identification element of the identification device placed on the receiving portion of the printing means; and means for printing information specific to the particular participant in response to identification of the particular participant by reading of the identification element.

* * * * *